United States Patent [19]

Bain et al.

[11] Patent Number: 4,818,371

[45] Date of Patent: Apr. 4, 1989

[54] VISCOSITY REDUCTION BY DIRECT OXIDATIVE HEATING

[75] Inventors: Richard L. Bain, Golden; John R. Larson, Boulder, both of Colo.

[73] Assignee: Resource Technology Associates, Boulder, Colo.

[21] Appl. No.: 58,878

[22] Filed: Jun. 5, 1987

[51] Int. Cl.[4] ..... C10G 9/00; C07C 37/00

[52] U.S. Cl. ..... 208/106; 208/3; 208/7; 208/46; 137/92

[58] Field of Search ..... 208/3, 7, 106; 137/92

[56] References Cited

U.S. PATENT DOCUMENTS

| | | | |
|---|---|---|---|
| 887,506 | 5/1908 | Beddoes | 37/67 |
| 1,449,227 | 3/1923 | Hanna et al. | 208/106 |
| 1,479,653 | 1/1924 | Davidson | 208/113 |
| 1,514,098 | 11/1924 | Palmer | 208/110.6 |
| 1,610,523 | 12/1926 | Hess | 208/103 |
| 1,828,691 | 10/1931 | Stransky et al. | 208/113 |
| 2,135,332 | 11/1938 | Gary | 196/62 |
| 2,160,814 | 6/1939 | Arveson | 196/150 |
| 2,421,528 | 6/1952 | Steffen | 166/21 |
| 2,587,703 | 3/1952 | Deansely | 196/65 |
| 2,651,601 | 9/1953 | Taff et al. | 196/73 |
| 2,752,407 | 6/1956 | Cahn | 260/683 |
| 2,818,419 | 12/1957 | McKenley et al. | 208/3 |
| 2,844,452 | 7/1958 | Husche | 208/7 |
| 2,862,870 | 12/1958 | Voorhies | 208/56 |
| 2,900,327 | 8/1959 | Beuther | 208/106 |
| 2,937,987 | 5/1960 | Jenkins | 208/108 |
| 2,981,747 | 4/1961 | Lang et al. | 208/3 |
| 3,132,088 | 5/1964 | Beuther et al. | 208/67 |
| 3,140,986 | 7/1964 | Hubbard | 202/52 |
| 3,156,642 | 11/1964 | Tranlham et al. | 208/3 |
| 3,170,863 | 2/1965 | Spillave et al. | 208/3 |
| 3,306,839 | 2/1967 | Vaell | 208/59 |
| 3,310,109 | 3/1967 | Marx | 166/7 |
| 3,320,154 | 5/1967 | Tokuhisha et al. | 208/106 |
| 3,324,028 | 6/1967 | Beuther et al. | 208/89 |
| 3,371,713 | 3/1968 | Silverman | 166/38 |
| 3,412,011 | 11/1968 | Lindsay | 208/113 |
| 3,439,741 | 4/1969 | Parker | 166/272 |
| 3,442,333 | 5/1969 | Meldau | 166/272 |
| 3,474,596 | 10/1969 | Scott et al. | 208/106 |
| 3,496,097 | 2/1970 | Engle | 208/208 |
| 3,523,071 | 8/1970 | Knapp et al. | 208/14 |
| 3,738,931 | 6/1973 | Frankovich et al. | 208/67 |
| 3,767,564 | 10/1973 | Youngblood et al. | 208/92 |
| 3,775,296 | 11/1973 | Chervenak et al. | 208/108 |
| 3,803,259 | 4/1974 | Porchey et al. | 260/683 R |
| 3,948,755 | 4/1976 | McCollum et al. | 208/11 |
| 3,984,305 | 10/1976 | Hosoi et al. | 208/57 |
| 3,989,618 | 11/1976 | McCollum et al. | 208/106 |
| 4,042,487 | 8/1977 | Seguchi et al. | 208/48 R |
| 4,089,340 | 5/1978 | Smith et al. | 137/13 |

(List continued on next page.)

FOREIGN PATENT DOCUMENTS

| | | | |
|---|---|---|---|
| 1184523 | 3/1985 | Canada | 196/164 |
| 1189011 | 6/1985 | Canada | 196/174 |
| 420650 | 3/1974 | U.S.S.R. | 208/106 |

OTHER PUBLICATIONS

"Conversion of Petroleum", A. N. Sachaen, D. Sc., Reinhold Publishing Corporation, New York, 1948, pp. 252–254.

"Visbreaking . . . Still the Basic Process for Fuel Reduction", M. G. Boone and D. F. Ferguson, The Oil and Gas Journal, Mar. 22, 1954, pp. 166–168.

"Visbreaking: A Flexible Process", A. Rnoe and C.de Blignieres, Hydrocarbon Processing, Jan. 1979, pp. 131–136.

"Visbreaking: More Feed for FCC", R. Hournac, J. Kunn and M. Nocarbartolo, Hydrocarbon Processing, Dec. 1979, pp. 97–102.

(List continued on next page.)

*Primary Examiner*—H. M. S. Sneed
*Assistant Examiner*—Helane Myers
*Attorney, Agent, or Firm*—Sheridan, Ross & McIntosh

[57] ABSTRACT

A method is disclosed for reducing the viscosity of a hydrocarbon feed. The feed is heated from an initial temperature to a second temperature and an oxidizing agent is introduced to oxidize components in the feed and provide heat to increase the temperature of the feed to a reaction temperature. The reaction temperature is maintained to produce a reaction product having a lower viscosity than the feed.

31 Claims, 2 Drawing Sheets

U.S. PATENT DOCUMENTS

| | | | |
|---|---|---|---|
| 4,248,306 | 2/1981 | VanHuisen | 166/305 R |
| 4,252,634 | 2/1981 | Knulbe et al. | 208/48 R |
| 4,298,455 | 11/1981 | Huang | 208/48 AA |
| 4,298,457 | 11/1981 | Oblad et al. | 208/107 |
| 4,334,976 | 6/1982 | Yan | 208/81 E |
| 4,354,922 | 10/1982 | Derbyshire et al. | 208/68 |
| 4,379,747 | 4/1983 | Yan | 208/251 H |
| 4,428,828 | 1/1984 | Bose | 208/208 R |
| 4,432,864 | 2/1984 | Myers et al. | 208/120 |
| 4,446,012 | 5/1984 | Murthy | 208/130 |
| 4,448,665 | 5/1984 | Zaczepinski et al. | 208/82 E |
| 4,454,023 | 6/1984 | Lutz | 208/96 |
| 4,469,587 | 9/1984 | Tailleur et al. | 208/61 |
| 4,478,705 | 10/1984 | Ganguli | 208/59 |
| 4,481,101 | 11/1984 | Yan | 208/50 |
| 4,508,614 | 4/1985 | Yan | 208/78 |
| 4,522,703 | 6/1985 | Yan et al. | 208/106 |
| 4,560,467 | 12/1985 | Slapp | 208/106 |
| 4,631,384 | 12/1986 | Cornu | 208/3 |

OTHER PUBLICATIONS

"Visbreaking Process has Strong Revival", Martin Hus, Technology Oil and Gas Journal, Apr. 13, 1981, vol. 79, pp. 109–120.

"Thermal Visbreaking of Heavy Residues", H. Beuther, R. G. Goldtnwalt, and W. C. Offutt, The Oil and Gas Journal, Nov. 9, 1959, vol. 57, No. 46, p. 151.

"Rebuilding Hydrocarbons", W. L. Nelson, Petroleum Refinery Engineering, 4th Ed. McGraw-Hill Book Company, Inc. 1958, pp. 52–66.

VISCOSITY REDUCTION BY DIRECT OXIDATIVE HEATING

FIELD OF THE INVENTION

This invention relates to a method for improving the transportability of heavy oils and other hydrocarbons by thermal viscosity reduction with reduced coke formation on reactor walls wherein an incremental portion of the heat is provided by direct oxidative heating of the hydrocarbon material.

BACKGROUND OF THE INVENTION

Vertical tube reactors which ordinarily involve the use of a subterranean U-tube configuration for providing a hydrostatic column of fluid sufficient to provide a selected pressure are well known. This type of reactor has been primarily used for the direct wet oxidation of materials in a waste stream and particularly for the direct wet oxidation of sewage sludge. Bower in U.S. Pat. No. 3,449,247 discloses a process in which combustible materials are disposed of by wet oxidation. A mixture of air, water and combustible material is directed into a shaft and air is injected into the mixture at the bottom of the hydrostatic column.

Lawless in U.S. Pat. No. 3,606,999 discloses a similar process in which a water solution or suspension of combustible solids is contacted with an oxygen-containing gas. Excess heat is removed from the apparatus by either diluting the feed with the product stream or withdrawing vapor, such as stream, from the system.

Land, et al. in U.S. Pat. No. 3,464,885 (issued Sept. 2, 1969) is directed to the use of a subterranean reactor for the digestion of wood chips. The method involves flowing the material through countercurrent coaxial flow paths within a well bore while flowing heated fluid coaxially of the material to be reacted. The reactants, such as sodium hydroxide and sodium sulfate, are combined with the wood chip stream prior to entry into the U-tube which is disposed within a well bore.

Titmas in U.S. Pat. No. 3,853,759 (issued Dec. 10, 1974) discloses a process in which sewage is thermally treated by limiting combustion of the material by restricting the process to the oxygen which is present in the sewage, i.e. no additional oxygen is added. Therefore, it is necessary to provide a continuous supply of heat energy to affect the thermal reactions.

McGrew in U.S. Pat. No. 4,272,383 (issued June 9, 1981) discloses the use of a vertical tube reactor to contact two reactants in a reaction zone. The method is primarily directed to the wet oxidation of sewage sludge in which substantially all of the organic material is oxidized. Heat exchange between the inflowing and product streams is contemplated. The temperature in the reaction zone is controlled by adding heat or cooling as necessary to maintain the selected temperature. It is disclosed that when gas is used in the reaction, it is preferred to use a series of enlarged bubbles known as "Taylor bubbles". These bubbles are formed in the influent stream and passed downward into the reaction zone. It is disclosed that preferably air is introduced into the influent stream at different points with the amount of air equalizing one volume of air per volume of liquid at each injection point. While such a large amount of oxygen can be needed to oxidize minor organic components dissolved or suspended in a primarily aqueous liquid, this process is not feasible when the liquid stream is primarily a mixture of hydrocarbons. The presence of such large volumes of oxygen could result in an uncontrollable exothermic reaction.

The above-cited patents which disclose vertical tube reactor systems describe the use of such systems with primarily aqueous streams. None of these patents describe treatment of a primarily hydrocarbon stream. Specifically, there is no suggestion of the thermal treatment of a hydrocarbon stream in a vertical tube reactor system.

The reduction in viscosity of heavy hydrocarbon material by thermal treatment are well known. The thermal cracking known as "visbreaking" involves the treatment of hydrocarbon materials at elevated temperatures and pressures. Such processes are exemplified by Biceroglu, et al. in U.S. Pat. No. 4,462,895 (1984), Beuther, et al. in U.S. Pat. No. 3,132,088 (1964), Taff, et al. in U.S. Pat. No. 2,695,264 (1954), and Shu, et al. in U.S. Pat. No. 4,504,377 (1985). Such processes are commonly used in refineries where there are the necessary distillation units to provide selective fractions to the visbreaking unit and the necessary product treatment facilities to handle the gaseous and low boiling products from the visbreaking unit. Such capital intensive processes do not readily lend themselves to the treatment of heavy oils at the production site to improve their transportability.

Co-pending and commonly assigned application U.S. Ser. No. 771,205 filed Aug. 30, 1985 now abandoned, discloses a method for viscosity reduction of a hydrocarbon feed in the field. In this process a vertical tube reactor is used to create a hydrostatic pressure on the crude oil feed and the feed is heated by an external heat source to provide the viscosity reduction necessary to improve transportability of the feed from the production area. The temperature differential between the heat source and the feed is maintained small to minimize the formation of coke.

Commonly assigned U.S. Pat. No. 4,648,964 of Leto et al. (1987) discloses the use of a vertical tube reactor to separate hydrocarbons from tar sands froth. The formation of coke deposits on the walls of the reaction vessels or heating surfaces has been a continuing problem. It has been disclosed that at higher severities there is an increased tendency to form coke deposits in the heating zone or furnace. Black in U.S. Pat. No. 1,720,070 teaches that operating at lower temperatures for increased lengths of time provides "a much smaller amount of carbon is deposited than is deposited at higher temperatures." Akbar et al., "Visbreaking Uses Soaker Drum", Hydrocarbon Processing, May 1981, p. 81 discloses that, when there is a high temperature differential between the tube wall in a furnace cracker and the bulk temperature of the oil, the material in the boundary layer adjacent to the tube wall gets overcracked and excessive coke formation occurs. In furnace cracking this boundary layer is commonly about 30° C. to 40° C. higher than the bulk temperature.

The problem associated with excessive coke formation in the boundary layer stems from the fact that the coke adheres to vessel walls. This coating of material acts to insulate the reaction vessel which necessitates additional heating for sufficient viscosity reduction. The added heat compounds the problem by further increasing coke formation.

In refinery operations, coke formation in viscosity reduction processes can be tolerated because frequent shutdowns of the process for coke removal are possible since storage space for the feedstock is usually available. However, this limitation is unacceptable in a field operation where crude is continually produced and must be rapidly transported. Such periodic shutdowns are also unacceptable with a vertical tube reactor system. In the co-pending application Ser. No. 771,205, the temperature difference between the heat source and the feed is kept small to minimize formation of coke. However, this process still has the limitation that the temperature of the wall of the reaction vessel is necessarily higher than the temperature of the bulk of the hydrocarbon stream. Consequently, over a period of time coke formation can occur which requires either a decoking operation or shutdown of the unit.

Accordingly, there is a need for an improved method for reducing the viscosity of recovered heavy hydrocarbon material in which coking of reactor vessels can be substantially reduced.

The present invention provides a method for reducing the viscosity of a hydrocarbon feed in which a final incremental amount of heat necessary for increased thermaly degradation of heavy components is provided by the exothermic oxidation of components in the feed. This process avoids undesirable coking in the reactor vessel by maintaining the temperature in the boundary layer of the stream near the vessel walls below coking temperatures.

SUMMARY OF THE INVENTION

The present invention comprises a process for reducing the viscosity of a hydrocarbon composition in which a feed stream of the composition having a core portion and a boundary layer is introduced into a vessel. The bulk temperature of the stream is increased from a first bulk temperature to a second bulk temperature. An oxidizing agent is introduced into the core portion of the stream to oxidize components in the stream and provide heat to the core portion of the stream to provide a bulk reaction temperature greater than the second temperature. The amount of the oxidizing agent is controlled to maintain the reaction temperature below the coking temperature of the feed. The reaction bulk temperature is maintained to produce a reaction product having a lower viscosity than the feed.

In another embodiment, the instant invention comprises a method for reducing viscosity of a hydrocarbon composition using a vertical tube reactor. An influent stream of the hydrocarbon feed is increased from a first temperature to a second temperature by heat exchange between the influent stream and effluent product stream. At least one of the streams is in turbulent flow during the heat exchange. The pressure on the hydrocarbon feed is increased from a first pressure to a second pressure by a hydrostatic head. An incremental amount of heat necessary to increase the bulk temperature of the feed from the second temperature to a reaction temperature is provided by introducing an oxidizing agent into the core portion of the feed stream to oxidize components in the feed.

In another embodiment, the instant invention comprises a method for reducing the viscosity of a hydrocarbon feed by thermal degradation of heavy molecular weight components of the feed at a reaction temperature. The feed is heated with a heat source to below a reaction temperature. The incremental amount of heat necessary to heat the feed to the reaction temperature is provided by internal combustion of a portion of the feed.

DETAILED DESCRIPTION OF THE INVENTION

Figure 1:
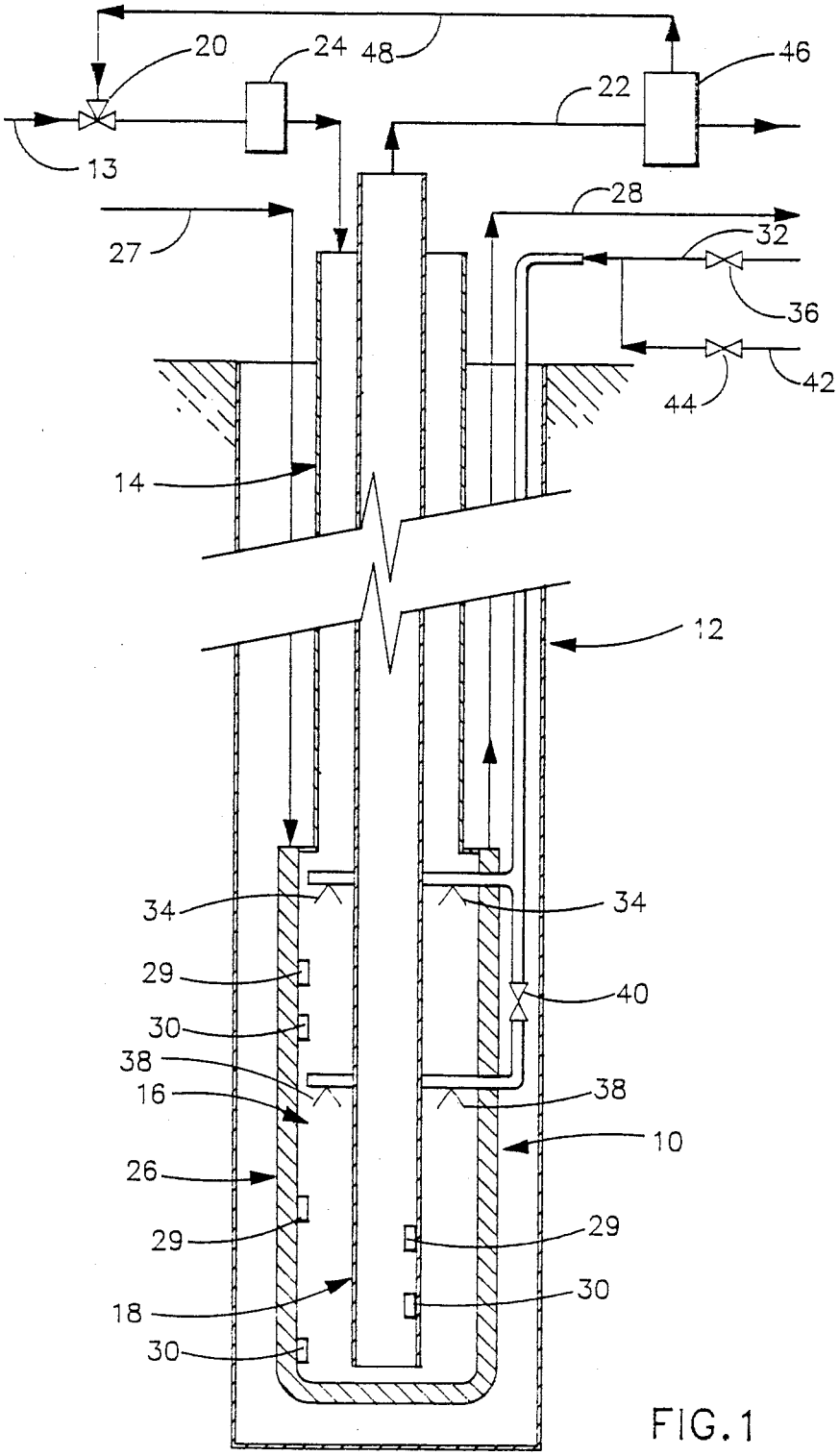
FIG. 1 is a schematic representation of apparatus useful in the practice of the present process.

As used herein, the term "boundary layer" is defined as the thin layer of the hydrocarbon stream immediately adjacent to reactor walls or other stationary surfaces in the reactor vessel, this layer being characterized by very low fluid velocities.

As used herein, the term "core portion" is defined as the portion of the hydrocarbon stream other than the boundary layer which is characterized by flow velocities which are higher than boundary layer flow velocities. The core portion can be in laminar or turbulent flow.

As used herein, the term "bulk temperature" is defined as the average temperature in a cross-sectional segment of the core portion in the hydrocarbon stream in which there is sufficient mixing of the stream to achieve a substantially uniform temperature throughout the segment.

As used herein, the term "coking temperature" is defined as a bulk temperature at which there is at least about 0.5 weight percent solid coke formation in a 24 hour period (based on the hydrocarbon stream).

The present invention involves providing an incremental amount of heat to a hydrocarbon stream by introducing an oxidizing agent into the core portion of the stream. The oxidizing agent rapidly oxidizes components in the stream in an exothermic oxidation reaction. By distributing this heat in the moving stream, an increase in the bulk temperature of the stream is provided. This reaction temperature is the temperature at which the rate of viscosity reduction is substantially increased. The oxidation reaction is controlled so that the increased bulk temperature (reaction temperature) is below the coking temperature. As discussed above, maintaining the bulk temperature below the coking temperature limits the temperature of the boundary layer in the reactor vessel which prevents excessive formation of coke on the walls of the reactor vessel.

It has been found that by practice of the present invention, the viscosity of a hydrocarbon feed can be significantly reduced without the formation of substantial coke deposits on the walls of the reactor vessel. While the process of coking is not fully understood, it has been reported that increased severity of conditions increase coke formation. It is known that materials such as asphaltenes are more likely to form coke. Once these materials precipitate and solidify on surfaces, it is difficult to dissolve them before coke deposits are formed. Coke tends to build on the reactor wall or other heating surface because in most systems these surfaces must be heated significantly above the desired reaction temperature to attain bulk temperatures sufficient to effect acceptable rates of viscosity reduction. Such "external heating" promotes coke formation on reactor walls.

Practice of the present invention avoids these problems associated with external heating. The increment of heat necessary to increase the bulk temperature of the stream to effect substantially increased rates of viscosity reduction is provided by internal heating through direct oxidation of components in the core portion of the stream. Consequently, coke formation on reactor walls or other surfaces in the reactor vessel is substantially reduced since these surfaces and the boundary layer of feed adjacent to the surfaces are not heated above the coking temperature.

While practice of the present invention substantially reduces formation of coke on reactor vessel walls, some coke formation can occur over time. The amount of coke build-up is affected by the type of feed, the quantity of feed which is processed as well as process conditions. While some coke build-up can be tolerated in most viscosity reduction processes, the present invention is less sensitive to coke formation than systems which rely entirely on external heating. Coke formation on reactor walls insulates the reactor and decreases the amount of heat added to the stream by an external heat source. To maintain required temperatures for viscosity reduction, external heat must be increased which causes additional coke formation. However there is a significant advantage in the present process since coke formation in the reactor does not require additional external heating because the final increment of heat is provided internally. The amount of coke formation in the present process which would necessitate a decoking procedure depends on the particular reaction vessel in use and the point at which the operation becomes impaired by coke buildup.

Internal heating is achieved by oxidizing a part of the core portion of the hydrocarbon stream. This exothermic reaction is controlled so that the bulk temperature remains below the coking temperature. It should be appreciated that between the region in the reactor vessel where the oxidation reaction occurs and where mixing of the stream has achieved a substantially uniform temperature throughout a cross-sectional segment of the stream, localized temperatures above the coking temperature can be expected to occur. Such temperatures can cause some coke formation in the stream. These coke particles, however, can be substantially prevented from adhering to any surfaces by the physical action of the flow of the stream.

It was anticipated that direct oxidation of the hydrocarbon stream would cause formation of oxygenated by-products, such as aldehydes, ketones or carboxylic acids. Surprisingly, it has been found that production of these and similar components by the present process is unexpectly low. This result is beneficial because the presence of such compounds lowers the value of the hydrocarbon product and can result in decreased storage stability of the product. It has been unexpectedly found that the primary products of the oxidation reaction are carbon dioxide, carbon monoxide and water.

The process of the present invention is broadly applicable to reducing the viscosity of hyrocarbon feeds. The terms "hydrocarbon stream" and "hydrocarbon feed" are used interchangeably herein to mean a liquid stream which contains primarily hydrocarbonaceous components but can also contain smaller amounts of other components, for example, water. The present invention is especially useful for treating heavy oil crudes of a nature and viscosity which renders them unsuitable for direct pipeline transport. This includes feeds having a viscosity above about 1000 centipoise (cp) at 25° C. (unless otherwise indicated, viscosity referred to herein is at 25° C.), a pour point above about 15° C. or an API gravity at 25° C. of about 15° and below. The advantages of reduced viscosity, increased API gravity and/or reduced pour point can be achieved by practice of the present invention without regard to the initial viscosity, API gravity or pour point of the feed. Additionally, if desired, a diluent can be added to the feed stream or to the reaction product from the instant process in order to further reduce the viscosity. Heating of the product in order to reduce the viscosity or maintain an acceptable viscosity for a particular pipeline or transportation medium is also possible.

Hydrocarbon feeds which can be used in the instant process include, but are not limited to, heavy whole crude oil, tarsands, bitumen, kerogen, and shale oils. Examples of heavy crude oil are Venezuelan Boscan crude oil, Canadian Cold Lake crude oil, Venezuelan Cerro Negro crude oil and California Huntington Beach crude oil. In practice, the most significant reductions in viscosity are achieved when the starting feed is more viscous.

The vertical tube reactor system useful in the instant invention has a heat exchange section, combustion zone, and a reaction zone. The heat exchange section is adapted to provide for heat exchange between the influent hydrocarbon feed stream and the effluent product stream. The combustion zone is the region in which oxidizing agent is introduced into the core portion of the hydrocarbon stream. The reaction zone is the region in which the bulk temperature of the hydrocarbon stream is greater than the maximum temperature achieved by heat exchange. There can be substantial overlap between the combustion zone and the reaction zone.

In the instant process, the hydrocarbon feed stream comprising a core portion and a boundary layer is introduced into the inlet of the vertical tube reactor. The influent hydrocarbon stream is at a first temperature ($T_1$) and an initial pressure ($P_1$). As the influent hydrocarbon stream travels down the vertical tube reactor, the pressure increases due to the hydrostatic column of fluid. Additionally, the temperature of the influent stream increases to a second temperature ($T_2$) due to heat exchange with the effluent product stream. An oxidizing agent is introduced into the core portion of the hydrocarbon stream to increase the bulk temperature of the hydrocarbon stream to a pre-selected reaction temperature ($T_{rx}$).

It is important that the temperature increment between the second temperature and the reaction temperature is small because less feed must be consumed in the oxidation reaction to provide the necessary heat and fewer oxidation products are formed. Additionally, the greater the temperature increment, the larger the combustion zone needed to provide the necessary heat to increase the bulk temperature of the stream from the second temperature to the reaction temperature. It is preferred that the temperature increment between the reaction temperature and the second temperature of the hydrocarbon stream is less than about 35° C. and more preferably less than about 25° C.

In order to achieve the second temperature necessary for the instant process to operate efficiently, it is necessary for the heat exchange between the influent hydrocarbon stream and the effluent product stream to be more efficient than those disclosed in the known patents relating to vertical tube reactors. The temperature of the influent stream achievable by heat exchange with the reaction product is limited by a number of factors including the temperature of the reaction product, the heat exchange surface area, and the velocities of the hydrocarbon streams. In order to achieve the necessary heat exchange efficiencies, it has been found that at least one of and preferably both the influent feed stream and the product stream are in substantially vertical multiphase flow. It has been found that when both streams are in substantially vertical multiphase flow an increase in heat exchange efficiency of at least about 100% can be achieved compared to heat exchange when neither stream is in multiphase flow. This allows a second temperature to be attained which is sufficiently close to the necessary reaction temperature to allow direct oxidative heating by introducing an oxidizing agent.

The oxidizing agent of the present invention is a material which rapidly exothermically oxidizes the hydrocarbon feed under chosen reaction conditions. The agent is selected so that essentially all of the agent reacts with the feed. Various oxidizing agents are suitable for use in the present invention. Such agents include, but are not limited to oxygen and hydrogen peroxide. The oxidizing agent can be optionally mixed with a nonreactive gas, such as nitrogen, and air or enriched air can be used in the present process. Preferably enriched air is used.

The amount of the oxidizing agent injected into the hydrocarbon stream affects the amount of heat generated by the oxidation reaction and is the primary factor for controlling the temperature increase in the stream from the oxidation reaction. The amount of oxidizing agent required for a particular volume of hydrocarbon feed in operation of the invention can be substantially defined with four variables: (1) the heat required to raise the temperature of that volume of the feed from the second temperature to a reaction temperature, (2) the heat of cracking of that volume of the feed (3) the heat loss from that volume of the feed to the environment in the reaction zone, and (4) the heat of combustion of the particular feed. The sum of the first three of these quantities equal the amount of heat that must be generated from the oxidation of some portion of the feed. The amount of feed which must be oxidized depends on the heat of combustion of the particular feed.

With regard to the variables discussed above, it is apparent that as the difference between the second temperature and the reaction temperature increases an increased flow rate of oxidizing agent is necessary to generate additional heat by the oxidation of a larger amount of the feed. As stated above, the amount of oxidizing agent required in the process is also dependent on the heat of cracking of the feed. This characteristic is variable between feeds. The oxidizing agent flow rate is also affected by heat loss from the hydrocarbon stream to the environment. A greater heat loss requires more heat generation initially and, therefore, the use of more oxidizing agent.

In operation of the invention, the amount of oxidizing agent introduced to the reactor vessel is used to control the oxidation reaction. The desired flow rate for a given concentration can be estimated by calculation using the variables discussed above. If the exact values for each variable is known, the amount of oxidizing agent required (assuming the heat of oxidation is known) can be determined. In practice, these values must ordinarily be estimated. Such an estimate can be used to determine an initial flow rate of oxidizing agent to use; however, actual control is based on a measured variable such as the bulk temperature of the hydrocarbon stream. The bulk temperature downstream from the oxidation reaction is ordinarily monitored. The bulk temperature should remain below the coking temperature so that the reactor walls and boundary layer are not heated to a temperature where excessive coke formation occurs. If the bulk temperature becomes too high, the flow of oxidizing agent is reduced until the preselected bulk temperature is attained. In the bulk temperature is too low to achieve acceptable viscosity reduction, the amount of oxidizing agent introduced into the system is increased until the appropriate reaction temperature is attained. Monitoring the pressure in the reaction zone can also be used to control the amount of oxidizing agent introduced into the hydrocarbon stream. The detection of pressure surges or fluctuations indicates that the amount of oxidizing agent being introduced into the hydrocarbon stream should be decreased.

As used herein, the term "reaction temperature" refers to the maximum bulk temperature of the hydrocarbon stram reached in the process. It is understood that some thermal cracking can occur at lower temperatures. The term "reaction zone" refers to the region in the process which begins at the point the oxidizing agent is introduced and ends where heat exchange between the reaction product effluent stream and the influent hydrocarbon stream begins. The maximum useful bulk temperature in the instant process is the coking temperature of the particular feedstock. In ordinary operation, the bulk temperature of the hydrocarbon stream is maintained below the coking temperature. At a minimum, the reaction temperature used for practice of the instant process is high enough to initiate some thermal cracking reaction. For most feeds, the reaction temperature is above about 300° C. and less than about 475° C., more typically in the range of about 350° C. to about 450° C., and more often in the range of about 375° C. to about 435° C.

The hydrocarbon stream and reaction zone is preferably maintained under a superatmospheric pressure typically above about 1,000 pounds per square inch absolute (psi). The high pressure serves to maintain volatile components in the hydrocarbon stream in liquid phase. The pressure also maintains products and by-products from the oxidation reaction and thermal cracking reaction in solution in the hydrocarbon stream. It is important to maximize the liquid phase in the reaction zone to minimize the concentration of asphaltenes and other coke precursors to avoid their precipitation from the hydrocarbon phase and possible deposition on internal reactor surfaces with subsequent coke formation. A small volume fraction of the stream can be in vapor phase and, in fact, a small volume of vapor phase can be beneficial in promoting mixing of the stream for rapid distribution of heat from the oxidation reaction throughout the core portion of the stream. Preferably the vapor phase should amount to no more than about 10 volume percent of the hydrocarbon stream. If the vapor phase comprises a substantial percent of the stream volume, it can become difficult to maintain a pressure balance in the reactor vessel.

As discussed hereinabove, at least a portion of the pressure on the hydrocarbon stream is achieved by a hydrostatic column of fluid. If it is desired that the reaction pressure be greater than that generated by the hydrostatic head, the initial pressure of the hydrocarbon feed stream can be increased by, for example, centrifugal pumps, to provide the desired total reaction pressure.

Upon introduction of the oxidizing agent into the hydrocarbon stream, oxidation of components of the stream occurs upon contact with the oxidizing agent. In a localized area immediately downstream from introduction of the agent, the temperature of the stream can be substantially higher than the reaction temperature because the oxidation reaction occurs essentially upon contact of the agent with hydrocarbon materials and is substantially complete before the heat generated by the reaction is dissipated in the stream. The use of oxygen as the oxidizing agent results in essentially a flame front in the hydrocarbon stream. It is desirable to very quickly distribute the heat from the oxidation reaction throughout the core portion to produce a substantially uniform temperature in the core portion, i.e. essentially a uniform bulk temperature. Mixing of the core portion ordinarily occurs essentially immediately as a result of turbulent flow of the hydrocarbon stream within the reaction vessel. If the flow velocity of the stream is low enough that the stream is in laminar flow, mixing can be induced with, for example, static mixers.

The rate at which the oxidizing agent is introduced into the hydrocarbon stream can be conveniently expressed as an amount of oxidizing agent per unit volume of the hydrocarbon stream. The flow rate of the oxidizing agent is controlled so that the heat generated by the oxidation reaction does not increase the bulk temperature of the hydrocarbon stream above the coking temperature. For example, in a typical operation in which the hydrocarbon stream comprises whole crude oil and oxygen is the oxidizing agent, the flow rate of oxygen is preferably less than about 40 scf/bbl (standard cubic feet per barrel), more preferably less than about 30 scf/bbl and most preferably less than about 20 scf/bbl.

The primary gaseous product of the oxidation reaction has been found to be carbon dioxide, which correlates closely with introduction of oxygen to the reactor. Other gases are also produced as by-products of the present process, however, these appear to correlate with temperature fluctuations in the stream rather than the combustion reaction. The major component of this gas make has been found to be methane with smaller amounts of ethane, propane, hydrogen, carbon monoxide, and hydrogen sulfide also being produced.

In operation of the present invention, it is important to maintain a positive pressure at the point of introduction of the agent into the stream. Otherwise, the hydrocarbon feed can flow into the oxidizing agent feedline possibly resulting in a violent oxidation reaction. Safe operation of the present process therefore, requires that the oxidizing agent be at a pressure greater than the pressure of the feed at the point of injection. To maintain a positive oxidizing agent flow and prevent the danger of hydrocarbon backup into the oxidizing agent addition line, a pressure drop across the injection nozzle of at least about 50 psi, and more preferably about 100 psi is preferred.

For safety reasons, it is also preferred to provide an emergency system in the even of a mechanical failure in the injection system. Such an emergency system floods the injection line with a non-reactive gas, such as nitrogen, during an injection system failure to prevent hydrocarbon material from entering the injection line and producing an explosive reaction with the oxidizing agent.

The spatial placement of the oxidizing agent injection nozzle can significantly affect the temperature of regions of the boundary layer as well as the reactor vessel wall. If the nozzle is placed within the core portion of the hydrocarbon stream close to the boundary layer, the resulting oxidation reaction can heat the boundary layer and the reactor vessel and cause substantial coke formation on the vessel. Likewise, if the injection nozzle is placed centrally within the core portion of the hydrocarbon stream but is directed toward a reactor wall or other surface, the resulting reaction can overheat the boundary layer and reactor vessel. Another danger associated with placement of the oxidizing agent injection nozzle is that if the nozzle is too near the reactor vessel or wall or is pointed toward the reactor vessel wall, the oxidation reaction can degrade or melt the wall causing a system failure. In operation of the process, the oxidizing agent injection nozzle is located centrally in the core portion of the hydrocarbon stream and is directed on a line substantially parallel to the flow of the hydrocarbon stream. This placement of the nozzle acts to localize the oxidation reaction within the core portion of the hydrocarbon stream away from the boundary layer, thereby minimizing the temperature in the boundary layer.

The injection nozzle should also be oriented relative to the flow of the hydrocarbon stream so that heat generated by the oxidation reaction is carried away from the nozzle to prevent thermal degradation of the nozzle itself. Injection of the oxidizing agent in the same direction as the flow of the hydrocarbon stream, given a sufficient flow rate, successfully removes heat from the nozzle.

Heat loss to the outside environment from the central portion of the stream outward is anticipated as heat is generated internally by direct oxidative heating. Some heat loss can occur even if the reactor vessel is insulated. Consequently, it may be necessary to use multiple sites for introduction of oxidizing agents to provide sufficient heat for viscosity reduction or to maintain a given temperature for a longer time than possible with a single injection site. In this embodiment, the injection sites are spaced so that as the bulk temperature of the stream falls below a temperature at which acceptable viscosity reduction is occurring, the stream passes another injection site to provide additional heat.

The instant invention can be more readily understood after a brief description of a typical application. As will be understood by those skilled in the art, other apparatus and configurations can be used in the practice of the present invention.

FIG. 1 depicts a subterranean vertical reactor 10 disposed in a well bore 12. The term "vertical" is used herein to mean that the tubular reactor is disposed toward the earth's center. It is contemplated that the tubular reactor can be oriented several degrees from true vertical, i.e. normally within about 10 degrees. During operation, flow of the hydrocarbon stream can be in either direction. As depicted, flow of the untreated hydrocarbon feed stream is through line 13 and into downcomer 14 to the reaction zone 16 and up the concentric riser 18. This arrangement provides for heat exchange between the outgoing product stream and the incoming feed stream. During start up, untreated hydrocarbon feed is introduced into the vertical tube reactor system through feed inlet 13, the flow rate being controlled by a valve 20. The hydrocarbon feed stream passes through downcomer 14 into reaction zone 16 and up through concentric riser 18 exiting through discharge line 22. During this operation unless external heat is provided to the hydrocarbon feed stream, the initial temperature $T_1$ is equal to the final heat exchange temperature $T_2$ and is also equal to the maximum temperature in the reaction zone $T_{rx}$ (assuming no heat loss to the environment). In order to achieve the necessary temperature $T_2$ at which oxidant can advantageously be introduced, heat is provided to the hydrocarbon stream through external heating. This can be provided by an above ground heating means 24. The necessary heat can also be provided by an external heating means 26 surrounding the reaction zone. Preferably, external heating means 26 is a jacket surrounding the reaction zone through which a heat exchange fluid is passed through inlet line 27 and outlet line 28. In another configuration not shown, the downcomer 14 can also be jacketed to allow external heating of the hydrocarbon stream at this location in addition to or instead of heating the reaction zone. Alternatively, the external heating means 26 can be used in conjunction with the above ground heating means 24 to provide the hydrocarbon feed stream at the desired temperature $T_2$. As the hydrocarbon stream passes down through downcomer 14, pressure on any particular volume segment increases due to the hydrostatic column of fluid above any particular point in the stream. The temperature of the hydrocarbon stream is determined by temperature monitors 29 which can be located in the hydrocarbon stream throughout the vertical tube reactor system. Pressure monitors 30 can also be located throughout the vertical tube reactor system to monitor any pressure increases or fluctuations in the fluid stream.

Once the desired temperature $T_2$ has been attained by external heating of the hydrocarbon stream, oxidant is introduced through line 32 to provide the incremental heat necessary to read the desired reaction temperature. As depicted, the oxidant enters the downflowing hydrocarbon stream through one or more nozzles 34. Flow rate of the oxidant is controlled by valve 36 which in turn can be controlled directly or indirectly by output from selected temperature monitors 29 and/or pressure monitors 30. If needed, additional oxidant injection nozzles 38 can be provided downstram from the initial nozzles 34. Nozzles 38 can be activated as needed to provide additional heat to the hydrocarbon stream by activating valve 40. As discussed hereinabove, for safety reasons it is important to maintain a positive pressure in line 32 relative to the pressure of the hydrocarbon at the injection nozzle. This prevents hydrocarbon feed from flowing into the oxidizing agent feed line possibly resulting in a violent oxidation reaction. Therefore, the oxidizing agent should be at a pressure greater than the pressure of the feed at the point of injection, preferably a source of a non-reactive gas such as nitrogen. Nitrogen can be introduced into line 32 through line 42 with the flow being controlled by valve 44. Ordinarily, in operation line 32 is purged with nitrogen prior to introduction of oxidizing agent. For safety reasons, an emergency system is provided in which valve 44 is activated and non-reactive gas introduced into line 32 in the event oxidant flow is interrupted.

When the desired reaction temperature has been attained, heat from the external heat source can be terminated. As used herein, the term "external heat" does not apply to the heat provided to the influent stream by thermal communication with the effluent product stream.

The temperature of the effluent product stream may be somewhat lower tha the reaction temperature when it initially comes in heat exchange contact with the influent stream due to some heat loss to the environment. The temperature of the effluent product stream is continually decreased by thermal communication with the inffluent stream until a final temperature ($T_f$) is attained as the effluent exits the reactor system.

The effluent hydrocarbon stream passes upward through riser 18 andout of heat exchange contact with influent hydrocarbon feed stream and out through line 22. The product can pass to a separation means 46 in which carbon dioxide and other gases are separated from liquid product and a more volatile fraction of the hydrocarbon stream can also be segregated. If desired, volatile components usually boiling below about 40° C. can be recycled through line 48 into the influent hydrocarbon feed stream. This can be done to induce vertical multiphase flow in the influent stream to substantially increase the efficiency of heat exchange between the influent and effluent streams. Alternatively, during start up when external heat is being supplied to increase the temperature of the hydrocarbon stream, the complete stream can be recycled through line 48 in order to minimize the total volume of hydrocarbon which must be heated by external means. In an option (not shown), the product stream can be brought into thermal communication with the influent stream above ground to provide a higher initial temperature of the influent stream. Alternatively, the product stream can be cooled by mixing with unreacted hydrocarbon to improve transportability.

Figure 2:
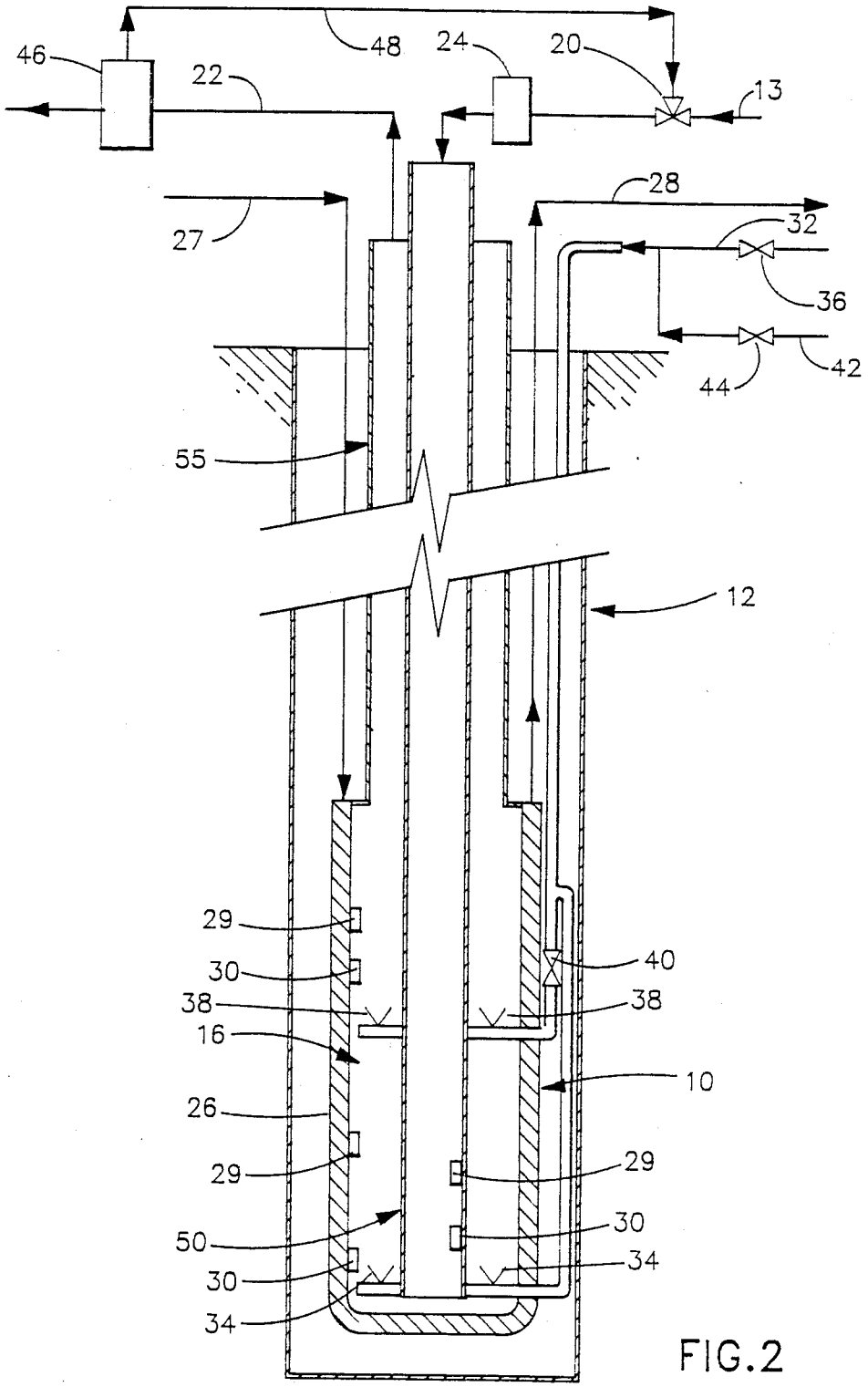
FIG. 2 is a representation of a preferred method of operation of the instant process.

FIG. 2 depicts a preferred method of operation in which the flow of influent feed is into the internal conduit 50 and up the external conduit 55. The initial nozzles 34 are located near the bottom of reaction zone 16. The nozzles are oriented to provide flow of oxidant essentially parallel to the flow of the feed stream. Additional nozzles 38 can be located downstream from the initial nozzles. In operation, untreated feed passes down conduit 50 and product passes up through conduit 55. This method of operation has the advantage that vapor phase regions readily flow upward with the product stream. This avoids the formation of static or slowly moving vapor phase regions or bubbles. Otherwise operation of the process in this mode is similar to that described for FIG. 1 hereinabove.

Substantial decreases in the viscosity and pour point of a hydrocarbon feed material and increased API values are obtained without significant production of coke on the walls of the reaction vessel by practice of the present invention. The following experimental results are provided for the purpose of illustration of the present invention and are not intended to limit the scope of the invention.

EXPERIMENTAL I

Fourteen runs were made to demonstrate direct oxidative heating of a hydrocarbon feed to reduce the viscosity of a Canadian Cold Lake Heavy Oil Feed. In Run Nos. 1 and 2 the bench-scale simulator described below was used. For subsequent runs, this apparatus was modified as will be explained in detail below. The feed material was held in oil storage tank having a 120-volt heater. The feed was through a circulating pump and a Pulsa-feeder metering pump. The feed material was conducted through three 15-foot tube-in-tube heat exchangers and through a 9-foot tube-in-tube heat exchanger consisting of ¼-inch tubing for the feed located inside a ½-inch tubing for the product. The material was then conducted into a fluidized bed send heater having a 15-inch inner diameter. As the material was introduced into the fluidized bed, the oxidizing agent, oxygen, was introduced into the feed material line. The material was then conducted through a 50-foot conduction heating coil section in the fluidized bed and then fed through the 9-foot tube-in-tube heat exchanger and the three 15-foot tube-in-tube heat exchangers. After the thermal exchange, the material was fed through a series of three pressure let-down valves into an expansion separator drum to separate the fluid product from the gaseous product.

In Run No. 3, the system was redesigned so that flow was reversed through the conduction heating coil and the feed entered at the bottom of the coil and exited from the top. Additionally, the oxygen injection apparatus was modified so that oxygen was injected at the bottom of the coil, and a section of ¼-inch tubing was inserted at the oxygen injection point to provide a higher velocity for increased mixing.

In Run No. 4, the system was modified so that as the oxygen was injected into the feed, the stream flowed through a 1-foot section of ¾-inch tubing.

In Run No. 5, 1-inch Cerefelt aluminum wrap was added to the reactor system as insulation from the 1-foot section of ¾-inch tubing into the fluidized bed heater.

In Run No. 6, a nitrogen line was added to the system to provide the capability of injecting nitrogen instead of oxygen or in combination with oxygen. This run was made with only nitrogen to produce a product sample for comparison with the combustion heating samples.

Run Nos. 7 and 8 used the same apparatus as used in Run No. 6 with the addition of a second set of check valves and an in-line filter in the oxygen line. These runs started with nitrogen flowing through the system, switching to oxygen when the reaction temperature was reached, and switching back to nitrogen at the end of the run. This procedure allowed for a constant flow of gas to prevent oil from seeping into the oxygen line.

In Run Nos. 9 and 10, the system was modified by introducing the oxygen into the ¾-inch reactor section below the introduction point of the feed material. Additionally, an in-line filter to the oxygen line was added just below the ¾-inch reactor section to prevent oil from entering the oxygen line. This apparatus was successful in these two runs for preventing oil seepage into the oxygen line.

In Run No. 11, a 1-inch reactor section was substituted for the ¾-inch reactor section and no oxygen gas was injected into the hydrocarbon feed.

Run No. 12 also used the 1-inch reactor section, and a 7-micron filter frit of sintered stainless steel was used to inject oxygen through the hydrocarbon stream to obtain better oxygen dispersion. This run was ended part way through because the frit became covered with coke material and gas flow into the stream was stopped. Run No. 13 used a 15-micron filter frit. During this run, a hole was burned in the frit.

In Run No. 14, oxygen was injected through a ⅛-inch, 0.049 wall tube and no filter was used.

In Run No. 15, the reactor consisted of 50 feet of ¼-inch tubing.

Table 1 describes the operating conditions for Run Nos. 1–14 and Table 2 provides a reaction product analysis for Run Nos. 1–14.

TABLE 1

Operating Conditions

| Run No. | Average Coil Temp °C. | Average Pressure psi | Temperature, °C. Pump Discharge | Fluid Bed In | ¾" Diameter Bottom | ¾" Diameter Top | Coil Bottom | Top Coil | Out Fluid Bed | Coaxial Discharge | Receiver | Bed |
|---|---|---|---|---|---|---|---|---|---|---|---|---|
| 1-1 | 402 | 1435 | 87 | 114 | | | 400 | 436 | 213 | 64 | 59 | 400 |
| -2 | 404 | 1479 | 88 | 115 | | | 402 | 487 | 185 | 64 | 61 | 400 |
| 2-1 | 400 | 1414 | 90 | 129 | | | 400 | 384 | 296 | 64 | 64 | 398 |
| -2 | 417 | 1416 | 89 | 117 | | | 416 | 539 | 206 | 56 | 66 | 417 |
| -3 | 401 | 1408 | 89 | 127 | | | 400 | 607 | 237 | 63 | 64 | 401 |
| -4 | 402 | 1402 | 89 | 116 | | | 402 | 626 | 222 | 60 | 65 | 401 |
| -5 | 401 | 1402 | 88 | 129 | | | 401 | 781 | 271 | 62 | 66 | 402 |
| 3-1 | 407 | 1506 | 79 | 150 | | | 380 | 396 | 277 | 54 | 65 | 411 |
| -2 | 408 | 1525 | 77 | 147 | | | 381 | 398 | 276 | 54 | 68 | 411 |
| -3 | 409 | 1088 | 78 | 194 | | | | 400 | 301 | 58 | 68 | 412 |
| -4 | 409 | 1010 | 75 | 164 | | | 374 | 398 | 238 | 58 | 67 | 411 |
| -5 | 410 | 1073 | 77 | 155 | | | 363 | 398 | 220 | 56 | 67 | 411 |
| -6 | 409 | 1080 | 76 | 159 | | | 363 | 397 | 223 | 58 | 68 | 411 |
| -7 | 408 | 1073 | 77 | 153 | | | 380 | 393 | 214 | 53 | 64 | 411 |
| 4-1 | 418 | 1350 | 81 | 146 | 509 | 406 | 418 | 404 | 209 | 55 | 60 | 420 |
| -2 | 419 | 1347 | 80 | 151 | 588 | 408 | 419 | 406 | 216 | 54 | 59 | 420 |
| -3 | 410 | 1351 | 80 | 153 | 562 | 400 | 410 | 397 | 215 | 55 | 61 | 411 |
| -4 | 409 | 1344 | 80 | 159 | 525 | 400 | 410 | 398 | 235 | 56 | 62 | 411 |
| -5 | 410 | 1348 | 79 | 158 | 465 | 401 | 411 | 398 | 231 | 55 | 63 | 409 |
| 5-1 | 411 | 1306 | 81 | 149 | 402 | 447 | 409 | 403 | 211 | 56 | 61 | 416 |
| -2 | 413 | 1300 | 81 | 112 | 550 | 420 | 420 | 401 | 195 | 49 | 58 | 415 |
| -3 | 413 | 1297 | 83 | 110 | 612 | 426 | 421 | 402 | 193 | 49 | 56 | 414 |
| 6-1 | 412 | 1035 | 78 | 98 | 393 | 410 | 411 | 285 | 283 | 56 | 51 | 408 |
| 7-1 | 411 | 1014 | 115 | 45 | 634 | 425 | 410 | 357 | 187 | 47 | 35 | 407 |
| 8-1 | 411 | 996 | 92 | 117 | 445 | 411 | 410 | 303 | 297 | 61 | 48 | 406 |
| -2 | 412 | 1006 | 94 | 124 | 479 | 413 | 411 | 303 | 301 | 64 | 49 | 405 |
| 9-1 | 411 | 1007 | 93 | 113 | 367 | 431 | 414 | 408 | 282 | 64 | 50 | 410 |
| -2 | 411 | 1010 | 94 | 103 | 370 | 427 | 413 | 407 | 282 | 61 | 47 | 408 |
| 10-1 | 411 | 998 | 93 | 116 | 364 | 419 | 413 | 406 | 274 | 64 | 50 | 408 |
| -2 | 412 | 1003 | 93 | 109 | 371 | 427 | 413 | 406 | 284 | 64 | 51 | 408 |
| 11-1 | 438 | 1015 | 86 | 118 | 404 | 430 | 437 | 430 | 287 | 67 | 43 | 434 |
| -2 | 438 | 1014 | 87 | 119 | 405 | 431 | 438 | 431 | 286 | 67 | 42 | 436 |
| -3 | 438 | 1007 | 87 | 120 | 405 | 431 | 437 | 431 | 272 | 66 | 43 | 436 |
| 12-1 | 413 | 1006 | 110 | 100 | 360 | 436 | 415 | 407 | 258 | 72 | 34 | 411 |
| -2 | 412 | 998 | 110 | 103 | 361 | 436 | 415 | 406 | 265 | 73 | 35 | 410 |
| 13-1 | 410 | 1007 | 111 | 107 | 377 | 396 | 407 | 408 | 274 | 77 | 38 | 409 |
| -2 | 412 | 1000 | 111 | 111 | 379 | 437 | 415 | 408 | 285 | 79 | 39 | 411 |
| -3 | 412 | 999 | 112 | 114 | 378 | 437 | 415 | 407 | 281 | 79 | 39 | 409 |

TABLE 1-continued

| Operating Conditions | | | | | | | | | | | | |
|---|---|---|---|---|---|---|---|---|---|---|---|---|
| -4 | 412 | 997 | 100 | 107 | 376 | 438 | 416 | 408 | 292 | 69 | 38 | 410 |
| 14-1 | 414 | 1006 | 106 | 98 | 386 | 435 | 416 | 403 | 276 | 73 | 34 | 410 |
| -2 | 414 | 1010 | 107 | 101 | 388 | 424 | 416 | 404 | 275 | 75 | 33 | 413 |
| 15-1 | 425 | 1030 | 115 | 183 | | | 426 | | 254 | 49 | | 430 |
| -2 | 425 | 1040 | 115 | 186 | | | 426 | | 268 | 49 | | 430 |
| -3 | 425 | 1040 | 115 | 192 | | | 425 | | 260 | 50 | | 430 |
| -4 | 425 | 1070 | 123 | 198 | | | 426 | | 248 | 49 | | 430 |

| Run No. | Pressure, psig Letdown | Oil grams/hr | Flow Rates $O_2$ in sccm | Off gas ccm |
|---|---|---|---|---|
| 1-1 | 1354 | 1767.2 | | |
| -2 | 1330 | 1853.9 | | |
| 2-1 | 1363 | 2047.2 | | |
| -2 | 1364 | 1012.8 | | |
| -3 | 1368 | 1646.4 | | |
| -4 | 1351 | 1423.4 | | |
| -5 | 1345 | | | |
| 3-1 | 1468 | 1835.8 | 830 | 278.0 |
| -2 | 1467 | 2184.8 | 340 | 254.9 |
| -3 | 1030 | 1998.9 | 170 | 347.2 |
| -4 | 844 | 1989.1 | 208 | 375.2 |
| -5 | 1013 | 1900.6 | 210 | 441.8 |
| -6 | 999 | 1875.4 | 262 | 504.1 |
| -7 | 958 | 1964.4 | 356 | 902.2 |
| 4-1 | 1292 | 1642.6 | 170 | 757.6 |
| -2 | 1286 | 1986.4 | 170 | 601.8 |
| -3 | 1292 | 1814.2 | 176 | 396.5 |
| -4 | 1284 | 1902.2 | 174 | 413.5 |
| -5 | 1295 | 1655.8 | 182 | 368.2 |
| 5-1 | 1236 | 1840.2 | 266 | 538.1 |
| -2 | 1239 | 1573.4 | 300 | 661.3 |
| -3 | 1237 | | 398 | 793.1 |
| 6-1 | 1032 | 1835.2 | 500 | 540.9 |
| 7-1 | 1009 | 572.1 | 240 | 234 |
| 8-1 | 999 | 2154.1 | 265 | 492 |
| -2 | 1009 | 2145.1 | 380 | 585 |
| 9-1 | 1010 | 1779.9 | 411 | 614 |
| -2 | 1018 | 1583.1 | 498 | 737 |
| 10-1 | 1001 | 1862.1 | 538 | 815 |
| -2 | 1010 | 1641.9 | 653 | 1003 |
| 11-1 | 1023 | 1786 | 0 | 909 |
| -2 | 1019 | 1692 | 0 | 1069 |
| -3 | 1015 | 1648 | 0 | 922 |
| 12-1 | 1010 | 1752 | 540 | 650 |
| -2 | 1000 | 1615 | 577 | 653 |
| 13-1 | 1004 | 1771 | $N_2$ = 488 | 687 |
| -2 | 1005 | 1702 | 310 | 600 |
| -3 | 1002 | 1631 | 320 | 566 |
| -4 | 1003 | 1582 | 302 | 632 |
| 14-1 | 1011 | 1630 | 495 | 755 |
| -2 | 1017 | 1771 | 533 | 1129 |
| 15-1 | 1029 | 1845 | | |
| -2 | 1032 | 1846 | | |
| -2 | 1016 | 1844 | | |
| -4 | 1036 | 1853 | | |

TABLE 2

| Cold Lake Crude | | | | | | | | | |
|---|---|---|---|---|---|---|---|---|---|
| | | | Reaction Product Analysis | | | | | | |
| | | | $O_2$ | Feed | | | Viscosity[2] | | |
| Run No. | Temp °C. | Pressure, psi | Inlet Wt % | $H_2O$ % | Time min[3] | Product $H_2O$ % | cp 25° C. | cp 80° C. | Gravity °API |
| Feed | | | | 3.6 | | | 28,845 | 489 | 9.9 |
| 1-1 | 400 | 1420 | | 3.6 | 9.0 | 0.0 | 19,717 | 578 | 11.3 |
| 1-2 | 400 | 1410 | | 3.6 | 12.9 | 0.0 | 14,541 | 265 | 11.3 |
| 2-1 | 400 | 1430 | | 3.6 | 15.3 | 0.1 | 6,175 | 213 | 11.7 |
| 2-2 | 415 | 1430 | | 3.6 | 23.6 | 0.0 | 3,150 | 140 | 11.7 |
| 2-3 | 400 | 1420 | | 3.6 | 12.3 | 0.1 | 4,155 | 217 | 11.6 |
| 2-4 | 400 | 1430 | | 3.6 | 19.5 | 0.0 | 8,399 | 263 | 11.7 |
| 2-5 | 400 | 1430 | | 3.6 | 19.3 | 0.0 | 4,846 | 162 | 11.7 |
| 3-1 | 407 | 1506 | 0.54 | 3.6 | 7.8 | 0.2 | 1,555 | 40 | 12.6 |
| 3-2 | 408 | 1525 | 0.41 | 3.6 | 9.6 | 1.3 | 1,076 | 41 | 12.6 |
| 3-3 | 409 | 1088 | 0.66 | 3.6 | 8.1 | 0.7 | 2,499 | 57 | 12.3 |
| 3-4 | 409 | 1010 | 0.82 | 3.6 | 6.3 | 0.0 | 3,190 | 63 | 13.0 |
| 3-5 | 410 | 1073 | 0.87 | 3.6 | 10.6 | 2.1 | 3,123 | 59 | 12.0 |
| 3-6 | 409 | 1080 | 1.10 | 3.6 | 7.2 | 0.8 | 2,975 | 55 | 12.3 |
| 3-7 | 408 | 1073 | 1.42 | 3.6 | 7.3 | 2.1 | 3,227 | 57 | 12.3 |
| 4-1 | 418 | 1350 | 0.81 | 3.6 | 10.1 | 0.6 | 1,219 | 51 | 12.9 |

TABLE 2-continued

Cold Lake Crude

| | | | | | | | | | |
|---|---|---|---|---|---|---|---|---|---|
| 4-2 | 419 | 1347 | 0.67 | 3.6 | 9.9 | 2.3 | 974 | 52 | 12.9 |
| 4-3 | 410 | 1351 | 0.75 | 3.6 | 12.1 | 1.4 | 2,356 | 73 | 12.6 |
| 4-4 | 409 | 1344 | 0.75 | 3.6 | 11.7 | 1.6 | 2,560 | 75 | 12.4 |
| 4-5 | 410 | 1348 | 0.86 | 3.6 | 9.2 | 1.1 | 2,546 | 82 | 12.4 |
| 5-1 | 411 | 1306 | 1.14 | 3.6 | 11.6 | 1.6 | 3,146 | 80 | 12.2 |
| 5-2 | 413 | 1300 | 1.50 | 3.6 | 11.9 | 1.1 | 1,004 | 50 | 12.7 |
| 5-3 | 413 | 1297 | 1.95 | 3.6 | 9.5 | 0.0 | 675 | 37 | 12.7 |
| 6-1 | 412 | 1035 | 0.00 | 3.6 | 8.2 | 1.4 | 3,164 | 134 | 12.6 |
| 7-1 | 411 | 1014 | 3.21 | 3.6 | 13.6 | 0.0 | 124 | 28 | 14.8 |
| 8-1 | 411 | 996 | 1.00 | 3.6 | 5.8 | 0.1 | 2,121 | 144 | 12.6 |
| | 412 | 1006 | 1.37 | 3.6 | 5.6 | 0.0 | 1,556 | 98 | 12.7 |
| 9-1 | 411 | 1007 | 1.80 | 3.6 | 7.5 | 0.3 | 1,873 | 108 | 12.6 |
| 9-2 | 411 | 1010 | 2.20 | 3.6 | 9.8 | 1.5 | 1,442 | 81 | 12.9 |
| 10-1 | 411 | 998 | 2.50 | 3.6 | 7.1 | 1.0 | 2,560 | 140 | 12.4 |
| 10-2 | 412 | 1003 | 3.12 | 3.6 | 7.4 | 0.0 | 1,753 | 101 | 12.6 |
| 11-1 | 438 | 1015 | 0.0 | 3.6 | 6.8 | 0.8 | 127 | 25 | 14.7 |
| 11-2 | 438 | 1014 | 0.0 | 3.6 | 4.9 | 0.1 | 86 | 17 | 14.8 |
| 11-3 | 438 | 1007 | 0.0 | 3.6 | 5.7 | 0.1 | 86 | 17 | 14.5 |
| 12-1 | 413 | 1006 | 2.42 | 3.6 | 12.2 | 0.7 | 847 | 97 | 13.0 |
| 12-2 | 412 | 998 | 2.81 | 3.6 | 8.9 | 0.0 | 730 | 75 | 13.0 |
| 13-1 | 410 | 1007 | 0.00 | 3.6 | 8.5 | 0.0 | 1,431 | 137 | 12.6 |
| 13-2 | 412 | 1000 | 1.43 | 3.6 | 7.2 | 0.0 | 524 | 79 | 13.5 |
| 13-3 | 412 | 999 | 1.54 | 3.6 | 7.6 | 0.0 | 557 | 75 | 13.5 |
| 13-4 | 412 | 997 | 1.58 | 3.6 | 8.4 | 0.6 | 426 | 61 | 13.5 |
| Feed (Test Run No. 14) | | | | 5.6 | | | 54,042 | 606 | 10.6 |
| 14-1 | 414 | 1006 | 2.38 | 5.6 | 8.4 | 1.9 | 551 | 58 | 13.3 |
| 14-2 | 414 | 1010 | 2.34 | 5.6 | 7.2 | 3.0 | 1,062 | 90 | 12.7 |
| 15-1 | 425 | 1030 | | 0.7 | 2.8 | 0.0 | 392 | 35 | 13.3 |
| 15-2 | 425 | 1040 | | 0.7 | 2.6 | 0.0 | 351 | 34 | 13.5 |
| 15-3 | 425 | 1040 | | 0.7 | 2.9 | 0.0 | 388 | 35 | 13.3 |
| 15-4 | 425 | 1070 | | 0.7 | 3.0 | 0.0 | 317 | 27 | 13.6 |

Reaction Product Analysis

| | Residual | | Asphaltene[1] | | Solid | Coke | Con-Carbon | Sulfur[1] | Pour Pt |
|---|---|---|---|---|---|---|---|---|---|
| Run No. | Wt % | Conv | Wt % | Alter % | Wt % | Wt % | Wt % | Wt % | °C. |
| Feed | 59.9 | | 17.4 | | 0.22 | 12.6 | | 4.4 | 10 |
| 1-1 | 59.9 | 0.0 | 14.2 | 18.6 | 0.08 | ND | 12.9 | 4.2 | 5 |
| 1-2 | 58.3 | 2.8 | 13.8 | 20.7 | 0.27 | ND | 13.5 | 4.2 | 3 |
| 2-1 | 58.9 | 1.6 | 13.9 | 19.9 | 0.04 | ND | 12.6 | 4.2 | 0 |
| 2-2 | 52.0 | 13.3 | 14.4 | 17.5 | 0.05 | ND | 12.6 | 4.2 | −3 |
| 2-3 | 58.1 | 3.1 | 13.8 | 20.9 | 0.04 | ND | 12.9 | 4.2 | −3 |
| 2-4 | 53.9 | 10.0 | 14.3 | 18.0 | 0.03 | ND | 12.4 | 4.3 | −4 |
| 2-5 | 55.3 | 7.7 | 13.6 | 22.0 | 0.02 | ND | 12.7 | 4.1 | −3 |
| 3-1 | 54.9 | 8.4 | 13.6 | 21.8 | 0.11 | ND | 11.8 | 4.3 | −13 |
| 3-2 | 53.9 | 10.0 | 13.8 | 20.7 | 0.11 | ND | 11.5 | 4.3 | −20 |
| 3-3 | 53.2 | 11.2 | 13.8 | 20.6 | 0.12 | ND | 12.0 | 4.3 | −15 |
| 3-4 | 57.3 | 4.3 | 13.2 | 24.3 | 0.10 | ND | 12.2 | 4.3 | −8 |
| 3-5 | 54.2 | 9.6 | 13.5 | 22.4 | 0.09 | ND | 11.4 | 4.3 | −3 |
| 3-6 | 59.2 | 1.2 | 13.4 | 23.1 | 0.09 | ND | 12.2 | 4.3 | −6 |
| 3-7 | 53.0 | 11.5 | 13.3 | 23.6 | 0.08 | ND | 12.6 | 4.2 | −7 |
| 4-1 | 55.1 | 8.0 | 13.1 | 24.7 | 0.08 | 0.18 | 13.0 | 4.1 | −10 |
| 4-2 | 50.2 | 16.2 | 13.1 | 24.7 | 0.08 | 0.18 | 13.1 | 4.0 | −16 |
| 4-3 | 58.7 | 2.0 | 13.1 | 14.7 | 0.02 | 0.16 | 12.8 | 4.0 | −10 |
| 4-4 | 51.0 | 14.9 | 13.1 | 24.7 | 0.04 | 0.14 | 12.9 | 4.1 | −8 |
| 4-5 | 57.2 | 4.6 | 13.2 | 24.1 | 0.06 | 0.16 | 12.3 | 4.1 | −8 |
| 5-1 | 48.9 | 18.4 | 13.6 | 21.8 | 0.09 | 0.14 | 12.6 | 4.1 | −14 |
| 5-2 | 45.2 | 24.5 | 13.6 | 21.8 | 0.13 | 0.18 | 12.6 | 4.0 | −14 |
| 5-3 | 47.5 | 20.7 | 13.5 | 22.4 | 0.10 | 0.15 | 13.7 | 4.0 | −20 |
| 6-1 | 51.2 | 14.5 | 13.4 | 23.0 | 0.04 | ND | 11.8 | 4.2 | −9 |
| 7-1 | 39.5 | 34.1 | 14.0 | 19.5 | 0.54 | ND | 13.9 | 3.9 | −32 |
| 8-1 | 49.7 | 17.0 | 13.5 | 22.4 | 0.07 | ND | 12.3 | 4.3 | −13 |
| 8-2 | 46.2 | 22.9 | 13.9 | 20.1 | 0.04 | ND | 12.6 | 4.2 | −13 |
| 9-1 | 51.0 | 14.9 | 12.9 | 25.6 | 0.25 | ND | 12.8 | 4.1 | −15 |
| 9-2 | 52.8 | 11.9 | 13.2 | 23.9 | 0.24 | ND | 13.1 | 4.1 | −19 |
| 10-1 | 56.6 | 5.5 | 13.3 | 23.8 | 0.12 | ND | 12.6 | 4.2 | −9 |
| 10-2 | 47.9 | 20.0 | 13.5 | 22.6 | 0.11 | ND | 12.9 | 4.2 | −12 |
| 11-1 | 36.8 | 38.6 | 11.4 | 34.8 | 0.59 | 1.48 | 15.5 | 3.6 | −36 |
| 11-2 | 35.2 | 41.2 | 10.7 | 38.3 | 0.47 | 1.36 | 14.8 | 3.5 | −41 |
| 11-3 | 35.5 | 36.5 | 12.5 | 28.3 | 0.54 | 1.43 | 13.0 | 3.7 | −33 |
| 12-1 | 48.2 | 13.8 | 14.1 | 19.0 | 0.08 | 0.21 | 12.9 | 4.0 | −19 |
| 12-2 | 52.9 | 11.7 | 14.0 | 19.5 | 0.04 | 0.17 | 12.9 | 4.0 | −14 |
| 13-1 | 55.1 | 8.1 | 13.9 | 20.1 | 0.00 | 0.02 | 11.7 | 3.9 | −12 |
| 13-2 | 49.9 | 16.7 | 14.0 | 19.5 | 0.04 | 0.06 | 12.4 | 3.8 | −21 |
| 13-3 | 47.2 | 21.2 | 14.3 | 17.8 | 0.07 | 0.09 | 3.8 | −17 | |
| 13-4 | 47.9 | 20.1 | 14.5 | 16.7 | 0.07 | 0.09 | 12.9 | 4.0 | −20 |
| Feed (For Run No. 14 Only) | 59.4 | | 19.3 | | 0.59 | | 12.9 | 4.2 | 12 |
| 14-1 | 42.9 | 27.7 | 12.7 | 34.2 | 0.43 | 0.73 | 13.8 | 3.9 | −22 |
| 14-2 | 48.1 | 19.7 | 12.4 | 35.8 | 0.14 | 0.44 | 13.5 | 4.0 | −23 |

TABLE 2-continued

| | | | | | | | | | |
|---|---|---|---|---|---|---|---|---|---|
| | | | | Cold Lake Crude | | | | | |
| 15-1 | 43.8 | 25.8 | 13.1 | 19.6 | 0.13 | 0.17 | 13.2 | 4.3 | |
| 15-2 | 43.8 | 25.8 | 13.4 | 17.8 | 0.14 | 0.18 | 13.2 | 4.3 | |
| 15-3 | 42.0 | 28.8 | 13.4 | 17.4 | 0.14 | 0.18 | 13.6 | 4.3 | −22 |
| 15-4 | 41.5 | 29.7 | 13.4 | 17.8 | 0.02 | 0.06 | 13.9 | 4.3 | |

[1]Water- and solids-free basis.
[2]Viscosity measured on oil after coke was removed.
[3]Residence time for continuous unit was calculated for temperatures within 5° C. of reaction temperature.

| | | IBP– | 450– | Residual | Volume, % | | | | | | |
|---|---|---|---|---|---|---|---|---|---|---|---|
| | Gas | 450° F. | 950° F. | +950° F. | IBP– | 450– | 650– | IBP–450° F. | | 450–950° F. | |
| Run No. | Wt % | Wt % | Wt % | Wt % | 450° F. | 650° F. | 950° F. | °API | Sp gr | °API | Sp gr |
| Feed | 0.8 | 2.5 | 36.8 | 59.9 | 2.9 | 17.7 | 21.0 | 33.3 | .858 | 18.7 | .942 |
| 1-1 | 2.2 | 1.7 | 36.2 | 59.9 | 2.1 | 16.6 | 22.4 | 39.3 | .829 | 21.1 | .927 |
| 1-2 | 2.0 | 3.9 | 35.9 | 58.3 | 4.6 | 21.1 | 17.6 | 35.8 | .846 | 20.5 | .931 |
| 2-1 | 2.0 | 1.3 | 37.8 | 58.9 | 1.6 | 18.0 | 22.6 | 40.1 | .825 | 21.3 | .926 |
| 2-2 | 1.9 | 3.4 | 42.7 | 52.0 | 4.1 | 19.5 | 26.5 | 36.5 | .842 | 20.5 | .931 |
| 2-3 | 4.0 | 2.0 | 35.9 | 58.1 | 2.5 | 20.9 | 18.6 | 40.1 | .825 | 22.8 | .917 |
| 2-4 | 3.1 | 3.5 | 39.6 | 53.9 | 4.1 | 19.2 | 23.5 | 35.7 | .847 | 20.5 | .931 |
| 2-5 | 3.1 | 2.9 | 38.8 | 55.3 | 3.4 | 19.8 | 21.8 | 36.5 | .843 | 20.8 | .929 |
| 3-1 | 3.8 | 2.2 | 39.1 | 54.9 | 2.7 | 20.0 | 21.9 | 43.8 | .807 | 22.0 | .922 |
| 3-2 | 1.4 | 5.9 | 38.8 | 53.9 | 7.0 | 21.5 | 19.7 | 38.5 | .832 | 21.3 | .926 |
| 3-3 | 2.7 | 3.5 | 40.7 | 53.2 | 4.1 | 21.7 | 21.6 | 38.2 | .834 | 21.0 | .928 |
| 3-4 | 2.0 | 3.3 | 37.5 | 57.3 | 3.9 | 18.5 | 21.5 | 40.5 | .823 | 21.8 | .923 |
| 3-5 | 0.9 | 3.4 | 41.6 | 54.2 | 4.1 | 19.1 | 25.2 | 39.7 | .826 | 21.0 | .928 |
| 3-6 | 2.5 | 2.4 | 35.9 | 59.2 | 2.8 | 19.0 | 19.3 | 37.6 | .837 | 21.0 | .928 |
| 3-7 | 3.1 | 4.2 | 39.7 | 53.0 | 5.0 | 19.2 | 23.5 | 36.6 | .842 | 20.7 | .930 |
| 4-1 | 4.9 | 1.9 | 38.2 | 55.1 | 2.3 | 18.4 | 23.3 | 39.5 | .827 | 22.6 | .918 |
| 4-2 | 3.3 | 4.2 | 42.4 | 50.2 | 5.0 | 21.2 | 24.0 | 38.2 | .834 | 19.7 | .936 |
| 4-3 | 2.5 | 2.8 | 36.0 | 58.7 | 3.4 | 15.3 | 23.4 | 41.8 | .817 | 22.3 | .920 |
| 4-4 | 2.5 | 6.2 | 40.3 | 51.0 | 7.3 | 21.8 | 20.9 | 35.7 | .846 | 19.8 | .935 |
| 4-5 | 2.3 | 2.3 | 38.2 | 57.2 | 2.7 | 20.5 | 20.5 | 38.0 | .835 | 22.3 | .920 |
| 5-1 | 1.9 | 4.7 | 44.5 | 48.9 | 5.5 | 22.0 | 25.3 | 36.5 | .842 | 20.3 | .932 |
| 5-2 | 2.8 | 7.1 | 45.0 | 45.2 | 8.5 | 22.7 | 25.4 | 39.7 | .827 | 20.3 | .932 |
| 5-3 | 4.5 | 4.5 | 43.5 | 47.5 | 5.4 | 20.3 | 26.7 | 38.4 | .833 | 22.1 | .921 |
| 6-1 | 2.2 | 6.0 | 40.6 | 51.2 | 7.1 | 20.0 | 22.7 | 39.6 | .827 | 20.3 | .932 |
| 7-1 | 8.3 | 8.3 | 43.9 | 39.2 | 10.4 | 23.4 | 24.2 | 42.3 | .814 | 20.5 | .931 |
| 8-1 | 3.2 | 6.2 | 40.9 | 49.7 | 7.3 | 17.2 | 26.7 | 35.5 | .847 | 22.3 | .920 |
| 8-2 | 4.6 | 5.0 | 44.2 | 46.2 | 6.0 | 17.3 | 30.2 | 38.1 | .834 | 21.3 | .926 |
| 9-1 | 3.3 | 4.2 | 41.6 | 51.0 | 5.0 | 19.0 | 25.2 | 39.5 | .827 | 21.1 | .927 |
| 9-2 | 2.3 | 5.4 | 39.5 | 52.8 | 6.6 | 18.1 | 24.1 | 42.8 | .812 | 22.0 | .921 |
| 10-1 | 2.5 | 2.6 | 38.2 | 56.6 | 3.2 | 18.2 | 22.6 | 43.6 | .808 | 22.0 | .922 |
| 10-2 | 3.9 | 4.9 | 43.3 | 47.9 | 5.7 | 19.4 | 26.8 | 36.0 | .845 | 21.0 | .928 |
| 11-1 | 4.4 | 12.6 | 46.2 | 36.8 | 15.7 | 23.7 | 25.9 | 45.8 | .798 | 20.8 | .929 |
| 11-2 | 9.4 | 10.2 | 45.3 | 35.2 | 12.4 | 25.5 | 24.0 | 38.8 | .831 | 21.6 | .924 |
| 11-3 | 6.1 | 11.7 | 46.8 | 35.5 | 14.3 | 26.1 | 23.9 | 42.4 | .814 | 20.3 | .932 |
| 12-1 | 2.2 | 4.1 | 45.5 | 48.2 | 4.9 | 24.0 | 24.1 | 42.9 | .812 | 21.0 | .928 |
| 12-2 | 3.5 | 2.0 | 41.7 | 52.9 | 2.3 | 17.5 | 26.7 | 40.7 | .822 | 21.8 | .923 |
| 13-1 | 2.4 | 1.8 | 40.8 | 55.1 | 2.1 | 16.4 | 27.1 | 38.3 | .833 | 21.8 | .923 |
| 13-2 | 4.3 | 3.3 | 42.5 | 49.9 | 4.0 | 19.7 | 25.6 | 40.1 | .824 | 21.8 | .923 |
| 13-3 | 4.8 | 3.5 | 44.5 | 47.2 | 4.2 | 20.1 | 27.1 | 37.7 | .837 | 21.0 | .928 |
| 13-4 | 4.3 | 5.9 | 42.0 | 47.9 | 6.9 | 19.4 | 25.2 | 38.2 | .833 | 21.0 | .928 |
| Feed (For Run No. 14 Only) | 1.9 | 4.3 | 34.4 | 59.4 | 5.4 | 18.2 | 18.7 | 47.7 | .790 | 21.6 | .924 |
| 14-1 | 1.7 | 9.0 | 46.4 | 42.9 | 10.9 | 22.0 | 26.6 | 43.4 | .809 | 19.8 | .935 |
| 14-2 | 2.9 | 6.9 | 42.1 | 48.1 | 8.6 | 18.1 | 27.0 | 45.3 | .800 | 21.1 | .927 |
| 15-1 | 3.5 | 7.4 | 45.3 | 43.8 | 8.9 | 23.3 | 25.1 | 40.0 | .825 | 20.3 | .932 |
| 15-2 | 3.5 | 9.3 | 43.4 | 43.8 | 12.0 | 22.9 | 24.9 | 39.4 | .828 | 19.4 | .938 |
| 15-3 | 3.1 | 10.0 | 44.9 | 42.0 | 11.2 | 21.6 | 24.6 | 38.5 | .833 | 20.2 | .933 |
| 15-4 | 3.8 | 8.4 | 46.3 | 41.5 | 10.1 | 24.3 | 25.1 | 39.4 | .828 | 20.0 | .934 |

| | Sulfur Distribution | | | | Sulfur Distribution | | | | Sulfur Distribution | | |
|---|---|---|---|---|---|---|---|---|---|---|---|
| Run No. | % Liquid | % Gas | % Solids | Run No. | % Liquid | % Gas | % Solids | Run No. | % Liquid | % Gas | % Solids |
| Feed | | | | 4-1 | 90 | 12 | 0 | 11-1 | 79 | 12 | 1.9 |
| 1-1 | 90 | 4 | 0 | 4-2 | 90 | 8 | 0 | 11-2 | 77 | 17 | 1.7 |
| 1-2 | 91 | 7 | 0 | 4-3 | 90 | 5 | 0 | 11-3 | 81 | 9 | 1.8 |
| 2-1 | 93 | 5 | 0 | 4-4 | 91 | 5 | 0 | 12-1 | 89 | 7 | 0 |
| 2-2 | 90 | 9 | 0 | 4-5 | 92 | 3 | 0 | 12-2 | 88 | 10 | 0 |
| 2-3 | 92 | 12 | 0 | 5-1 | 91 | 7 | 0 | 13-1 | 87 | 5 | 0 |
| 2-4 | 94 | 5 | 0 | 5-2 | 88 | 9 | 0 | 13-2 | 84 | 7 | 0 |
| 2-5 | 92 | 2 | 0 | 5-3 | 88 | 12 | 0 | 13-3 | 85 | 8 | 0 |
| 3-1 | 96 | 6 | 0 | 6-1 | 95 | ? | 0 | 13-4 | 89 | 8 | 0 |
| 3-2 | 96 | 5 | 0 | 7-1 | 81 | 28 | 0 | 14-1 | 91 | 6 | 0.7 |
| 3-3 | 97 | 4 | 0 | 8-1 | 96 | 5 | 0 | 14-2 | 92 | 7 | 0.4 |
| 3-4 | 97 | 4 | 0 | 8-2 | 94 | 7 | 0 | 15-1 | 92 | 10 | 0.38 |
| 3-5 | 96 | 5 | 0 | 9-1 | 92 | 6 | 0 | 15-2 | 92 | 10 | 0.39 |
| 3-6 | 96 | 6 | 0 | 9-2 | 91 | 7 | 0 | 15-3 | 92 | 9 | 0.40 |
| 3-7 | 92 | 8 | 0 | 10-1 | 93 | 5 | 0 | 15-4 | 92 | 11 | 0.13 |
| | | | | 10-2 | 91 | 10 | 0 | | | | |

Gas Analysis, %

TABLE 2-continued

| Cold Lake Crude | | | | | | | | | | | | | |
|---|---|---|---|---|---|---|---|---|---|---|---|---|---|
| Run No. | $H_2$ | $CH_4$ | CO | $CO_2$ | $C_2H_6$ | $H_2S$ | $C_3H_8$ | $C_2H_4$ | $C_3H_6$ | n-$C_4H_{10}$ | i-$C_4H_{10}$ | $N_2$ | Other |
| Feed | | | | | | | | | | | | | |
| 1-1 | 1.5 | 4.0 | 4.0 | 11.4 | 0.8 | 2.5 | 0.5 | 0.8 | 0.6 | 0.2 | 0.2 | 73.4 | 0.1 |
| 1-2 | 0.6 | 5.9 | 2.3 | 16.0 | 2.0 | 5.0 | 1.3 | 1.0 | 1.1 | 0.6 | 0.4 | 63.6 | 0.2 |
| 2-1 | 0.6 | 6.8 | 1.2 | 13.5 | 3.7 | 12.3 | 3.5 | 0.4 | 1.5 | 2.0 | 0.5 | 51.0 | 2.8 |
| 2-2 | 0.0 | 9.6 | 1.3 | 9.1 | 3.0 | 8.6 | 2.5 | 0.2 | 0.9 | 1.4 | 0.4 | 61.2 | 1.8 |
| 2-3 | 2.0 | 21.4 | 0.3 | 32.4 | 7.9 | 19.2 | 6.4 | 1.4 | 2.1 | 2.9 | 1.0 | | 3.2 |
| 2-4 | 1.3 | 17.5 | 4.8 | 57.2 | 3.7 | 7.0 | 3.4 | 0.5 | 1.2 | 1.2 | 0.4 | | 1.7 |
| 2-5 | 0.0 | 19.3 | 0.8 | 58.5 | 5.6 | 6.8 | 3.8 | 0.5 | 1.5 | 1.3 | 0.5 | | 1.6 |
| 3-1 | 1.7 | 33.4 | 0.5 | 5.0 | 12.3 | 28.0 | 8.8 | 0.4 | 2.5 | 3.4 | 1.4 | | 2.6 |
| 3-2 | 2.4 | 32.5 | 0.7 | 4.7 | 12.1 | 27.7 | 8.7 | 0.4 | 2.7 | 3.5 | 1.4 | | 3.5 |
| 3-3 | 2.1 | 22.9 | 1.7 | 33.7 | 7.6 | 17.6 | 5.6 | 0.6 | 2.3 | 2.4 | 0.8 | | 2.8 |
| 3-4 | 5.0 | 19.6 | 5.1 | 35.2 | 6.5 | 16.0 | 4.7 | 0.7 | 2.1 | 2.0 | 0.6 | | 2.6 |
| 3-5 | 1.0 | 19.6 | 5.0 | 39.1 | 6.7 | 16.1 | 4.9 | 0.5 | 2.0 | 2.0 | 0.8 | | 2.3 |
| 3-6 | 1.9 | 17.6 | 6.4 | 42.1 | 5.9 | 14.4 | 4.2 | 0.7 | 1.9 | 1.8 | 1.0 | | 2.1 |
| 3-7 | 2.8 | 16.0 | 7.9 | 45.1 | 5.1 | 12.9 | 3.5 | 0.9 | 1.9 | 1.5 | 0.4 | | 2.1 |
| 4-1 | 7.0 | 24.5 | 1.2 | 25.4 | 8.2 | 18.2 | 6.1 | 0.3 | 1.9 | 2.8 | 1.1 | | 3.1 |
| 4-2 | 6.1 | 25.9 | 0.7 | 27.5 | 8.5 | 17.6 | 6.2 | 0.3 | 1.9 | 2.6 | 1.0 | | 1.6 |
| 4-3 | 3.2 | 25.4 | 1.0 | 34.4 | 7.7 | 16.3 | 5.4 | 0.3 | 1.9 | 2.1 | 0.8 | | 1.5 |
| 4-4 | 8.1 | 25.0 | 0.6 | 34.5 | 7.6 | 12.8 | 5.3 | 0.4 | 1.8 | 1.8 | 0.8 | | 1.4 |
| 4-5 | 11.2 | 23.0 | 0.7 | 33.9 | 7.8 | 10.8 | 5.8 | 0.3 | 1.6 | 1.9 | 0.9 | | 2.0 |
| 5-1 | 3.5 | 24.5 | 1.1 | 33.3 | 7.5 | 17.2 | 5.3 | 0.4 | 1.9 | 2.2 | 0.8 | | 2.3 |
| 5-2 | 1.6 | 23.6 | 0.6 | 34.3 | 8.3 | 15.9 | 6.5 | 0.3 | 1.9 | 3.0 | 1.2 | | 2.8 |
| 5-3 | 3.1 | 23.8 | 0.3 | 33.4 | 8.3 | 17.1 | 6.3 | 0.3 | 0.8 | 2.8 | 1.1 | | 2.7 |
| 6-1 | No gas analysis | | | | | | | | | | | | |
| 7-1 | 1.6 | 19.4 | 0.6 | 24.5 | 11.8 | 19.1 | 10.2 | 0.8 | 2.0 | 4.4 | 2.2 | | 3.5 |
| 8-1 | 4.7 | 26.6 | 2.1 | 36.5 | 6.2 | 11.9 | 5.6 | 0.6 | 1.5 | 1.9 | 0.9 | | 1.6 |
| 8-2 | 4.3 | 22.8 | 3.1 | 37.3 | 7.2 | 12.5 | 5.1 | 1.1 | 2.0 | 1.9 | 0.8 | | 1.7 |
| 9-1 | 6.9 | 20.0 | 6.3 | 35.9 | 6.4 | 13.0 | 4.3 | 0.7 | 1.9 | 1.9 | 0.7 | | 2.1 |
| 9-2 | 10.2 | 19.6 | 6.3 | 36.8 | 5.7 | 11.2 | 3.8 | 0.6 | 1.6 | 1.6 | 0.6 | | 2.0 |
| 10-1 | 17.7 | 17.0 | 10.9 | 35.3 | 3.9 | 8.7 | 2.4 | 0.5 | 1.2 | 1.0 | 0.3 | | 1.1 |
| 10-2 | 10.4 | 16.7 | 6.1 | 43.1 | 4.6 | 11.2 | 3.0 | 0.5 | 1.4 | 1.2 | 0.4 | | 1.4 |
| 11-1 | 3.3 | 34.8 | 0.1 | 2.5 | 15.4 | 17.7 | 11.8 | 0.4 | 2.6 | 5.0 | 2.3 | | 4.1 |
| 11-2 | 0.9 | 36.4 | 0.1 | 2.6 | 16.0 | 17.2 | 12.3 | 0.4 | 2.4 | 5.1 | 2.4 | | 4.4 |
| 11-3 | 37.0 | 11.3 | 0.0 | 1.2 | 7.3 | 11.3 | 10.0 | 0.0 | 1.5 | 8.6 | 2.9 | | 9.1 |
| 12-1 | 4.7 | 19.4 | 2.3 | 39.5 | 10.6 | 13.0 | 4.3 | 0.5 | 1.6 | 1.8 | 0.6 | | 1.6 |
| 12-2 | 4.3 | 20.3 | 1.8 | 40.4 | 6.4 | 16.8 | 4.2 | 0.5 | 1.6 | 1.6 | 0.6 | | 1.6 |
| 13-1 | 1.0 | 10.1 | 0.3 | 1.2 | 3.7 | 8.4 | 2.5 | 0.3 | 1.0 | 0.9 | 0.3 | | 70.4[1] |
| 13-2 | 3.6 | 33.7 | 1.5 | 33.6 | 5.3 | 14.0 | 3.5 | 0.4 | 1.3 | 1.4 | 0.5 | | 1.3 |
| 13-3 | 4.2 | 24.8 | 2.5 | 32.3 | 8.0 | 15.3 | 5.7 | 0.4 | 1.8 | 2.3 | 0.9 | | 2.0 |
| 13-4 | 3.5 | 26.9 | 2.4 | 30.6 | 9.5 | 13.5 | 6.3 | 0.3 | 1.6 | 2.4 | 1.0 | | 2.0 |
| 14-1 | 9.4 | 24.4 | 20.0 | 22.3 | 6.0 | 8.9 | 3.7 | 0.8 | 1.7 | 0.8 | 0.5 | | 1.7 |
| 14-2 | 9.2 | 20.5 | 18.0 | 32.4 | 4.6 | 8.0 | 2.7 | 0.6 | 1.3 | 1.0 | 0.3 | | 1.3 |
| 15-1 | 0.0 | 29.2 | 0.4 | 2.7 | 24.4 | 22.5 | 18.2 | 0.0 | 0.0 | — | — | | — |
| 15-2 | 0.0 | 26.8 | 0.2 | 2.6 | 27.6 | 21.7 | 19.3 | 0.0 | 0.0 | — | — | | — |
| 15-3 | 1.9 | 31.0 | 0.4 | 2.5 | 24.0 | 20.5 | 17.4 | 0.0 | 0.0 | — | — | | — |
| 15-4 | 2.0 | 30.5 | 0.3 | 2.4 | 23.4 | 21.4 | 17.5 | 0.0 | 0.0 | — | — | | — |

[1]Includes 69.46% $N_2$.

EXPERIMENTAL II

A product sample from Run No. 5 in Experimental I was analyzed and compared with oil products obtained by indirect heating and with the initial feed material. The feed material was Canadian Cold Lake Heavy Oil. The comparison products were identified as Run No. 15 and Feed.

The API gravity and volume percent of various fractions of various materials were compared. Table 3 shows the results of these runs for the feed material, the product from Run No. 5, and Run No. 15 which was treated by indirecting heating.

TABLE 3

Comparison of Oil Treated by Direct Oxidative Heating with Oil Treated by Indirect Heating

| | FEED | RUN NO. 5 | RUN NO. 15 |
|---|---|---|---|
| API Gravity | 10.4 | 12.4 | 13.2 |
| Vol. % at 430° F. | 1.0 | 9.9 | 7.2 |
| Vol. % at 430°-650° F. | 14.3 | 22.9 | 24.9 |
| Vol. % at 650°-950° F. | 34.2 | 33.1 | 35.0 |

A mass spectrometric analysis of various oil fractions were conducted for the feed material and the products from Run No. 5 and Run No. 15. The results of these tests are shown in Table 4.

TABLE 4

Direct-Inlet Mass Spectrometric Analysis of Oil Fractions, IBP-430° F. Cuts

| STRUCTURAL TYPE | FEED WT. % | RUN NO. 5 WT. % |
|---|---|---|
| Paraffins | 29.6 | 34.4 |
| Cycloparaffins | 35.1 | 34.1 |
| Condensed Cycloparaffins | 27.5 | 19.1 |
| Alkyl Benzenes | 4.5 | 9.4 |
| Benzocycloparaffins | 1.2 | 1.4 |
| Benzodicycloparaffins | 0.7 | 0.6 |
| SUM | 98.6 | 99.0 |
| 2-Ring Aromatics | 1.3 | 1.0 |
| 3-Ring Aromatics | 0.1 | — |
| 4-Ring Aromatics | — | — |
| 5-Ring Aromatics | — | — |
| Other Aromatics | — | — |
| Sulfur Condensed Aromatics | — | — |
| Polars | ND | ND |
| Not Analyzed | — | — |
| SUM | 1.4 | 1.0 |

Direct-Inlet Mass Spectrometric Analysis of Oil Fractions, 430°-650° F. Cuts

TABLE 4-continued

| STRUCTURAL TYPE | FEED WT. % | RUN NO. 5 WT. % | RUN NO. 15 WT. % |
|---|---|---|---|
| Paraffins | 15.7 | 15.4 | 16.7 |
| Cycloparaffins | 20.5 | 18.6 | 15.3 |
| Condensed Cycloparaffins | 30.9 | 28.3 | 24.9 |
| Alkyl Benzenes | 9.5 | 13.1 | 15.2 |
| Benzocycloparaffins | 5.7 | 5.7 | 7.8 |
| Benzodicycloparaffins | 4.6 | 4.6 | 5.3 |
| SUM | 86.9 | 85.7 | 85.2 |
| 2-Ring Aromatics | 10.5 | 10.9 | 11.3 |
| 3-Ring Aromatics | 1.8 | 2.0 | 2.1 |
| 4-Ring Aromatics | 0.1 | 0.1 | 0.4 |
| 5-Ring Aromatics | — | — | — |
| Other Aromatics | — | — | — |
| Sulfur Condensed Aromatics | 0.7 | 1.2 | 1.0 |
| Polars | ND | ND | ND |
| Not Analyzed | — | — | — |
| SUM | 13.1 | 14.2 | 14.8 |

Direct-Inlet Mass Spectrometric Analysis of Oil Fractions, 650°-950° F. Cuts

| STRUCTURAL TYPE | FEED WT. % | RUN NO. 5 WT. % |
|---|---|---|
| Paraffins | 11.8 | 10.8 |
| Cycloparaffins | 11.0 | 10.2 |
| Condensed Cycloparaffins | 22.8 | 22.3 |
| Alkyl Benzenes | 12.3 | 13.8 |
| Benzocycloparafins | 6.7 | 7.1 |
| Benzodicycloparaffins | 6.0 | 6.6 |
| SUM | 70.6 | 70.8 |
| 2-Ring Aromatics | 17.2 | 17.8 |
| 3-Ring Aromatics | 7.2 | 6.8 |
| 4-Ring Aromatics | 1.3 | 1.0 |
| 5-Ring Aromatics | 0.4 | 0.3 |
| Other Aromatics | — | — |
| Sulfur Condensed Aromatics | 3.3 | 3.3 |
| Polars | ND | ND |
| Not Analyzed | — | — |
| SUM | 29.4 | 29.2 |

ND = Not determined.

EXPERIMENTAL III

The feed material and the product from Run No. 5 were analyzed for the polars content of the 430° F.-650° F. cuts. The results of this analysis are shown in Table 5. The feed material and the product from Run No. 5 were analyzed for concentration of phenols in the 430° F.-650° F. rotation. The results of this analysis are shown in Table 6.

TABLE 5

Polars Contents of 430° F.-650° F. Cuts

| STRUCTURAL TYPE | FEED WT. % | RUN NO. 5 |
|---|---|---|
| Wt. % non polars | 67.2 | 83.5 |
| Wt. % non acidic polars | 31.1 | 14.1 |
| Wt. % weak acids | 1.4 | 2.0 |
| Wt. % strong acids | 0.3 | 0.8 |

ND = Not Determined

TABLE 6

Concentration of Phenols by GC/MS in Weak Acid Fraction Ug/ml (ppm) in Extract

| COMPOUND TYPE | RUN NO. 5 430° F.-650° F. | FEED 430° F.-650° F. |
|---|---|---|
| Methyl phenols | 220 | 180 |
| 2-carbon alkyl subst. phenols | 480 | 500 |
| 3-carbon alkyl subst. phenols | 1600 | 560 |
| 4-carbon alkyl subst. phenols | 780 | 940 |
| 5-carbon alkyl subst. phenols | 700 | 360 |
| 6-carbon alkyl subst. phenols | 100 | 160 |

TABLE 6-continued

Concentration of Phenols by GC/MS in Weak Acid Fraction Ug/ml (ppm) in Extract

| COMPOUND TYPE | RUN NO. 5 430° F.-650° F. | FEED 430° F.-650° F. |
|---|---|---|
| Naphthols | 170 | 140 |
| Methyl naphthols | 560 | 300 |
| Dimethyl naphthols | 80 | ND |
| TOTAL | 4690 | 3140 |

EXPERIMENTAL IV

An elemental analysis of the feed material, the product from Run No. 7, and the product from Run No. 11 was conducted. The results of this analysis are shown in Table 7.

TABLE 7

Elemental Analysis of Whole Oils, Feed, Run No. 7, and Run No. 11

| SAMPLE | ELEMENT | WT. % IN OIL |
|---|---|---|
| Feed | C | 84.04 |
| | H | 10.42 |
| | N | 0.50 |
| | S | 4.65 |
| | TOTAL | 99.61 |
| | difference | 0.39 |
| | H/C ratio | 1.49 |
| Run No. 7 (oxygen) | C | 85.00 |
| | H | 10.22 |
| | N | 0.48 |
| | S | 4.01 |
| | TOTAL | 99.71 |
| | difference | 0.29 |
| | H/C ratio | 1.44 |
| Run No. 11 (indirect heat) | C | 83.9 |
| | H | 10.08 |
| | N | 0.50 |
| | S | 4.14 |
| | TOTAL | 98.62 |
| | difference | 1.38 |
| | H/C ratio | 1.44 |

The feed material, the product from Run No. 7, and the product from Run No. 11 were analyzed for sulfur distribution in various fractions of the samples. The results of these analyses are shown in Table 8.

TABLE 8

Sulfur Distribution in Oil Samples, Feed, Run No. 7, and Run No. 11

| DISTILLATION CUT | WT. % S FEED | WT. % S RUN NO. 7 | WT. % S RUN NO. 11 |
|---|---|---|---|
| Whole oil | 4.65 | 4.01 | 4.14 |
| IBP-430° F. | 0.92 | 2.30 | 2.34 |
| 430-650° F. | 2.47 | 2.80 | 3.14 |
| 650-950° F. | 3.54 | 3.90 | 3.90 |
| 950° F.+ | 5.57 | 5.38 | 5.50 |
| S in cuts/S in whole | 99.4% | 96.9% | 93.5% |

All values were obtained by X-ray fluroescence.

The feed material, the product from Run No. 7, and the product from Run No. 11 were run through distillations and analyzed with regard to API gravities for various fractions. The results of these runs are shown in Table 9.

TABLE 9

Distillations and API Gravities of Oils, Feed, Run No. 7, and Run No. 11*

| SAMPLE AND CUT | API GRAVITY | VOL. % | SUM. VOL. % |
|---|---|---|---|
| Feed | | | |
| IBP–430° F. | 32.4 | 4.5 | 4.5 |
| 430–650° F. | 24.6 | 13.8 | 18.3 |
| 650–950° F. | 16.3 | 29.9 | 48.2 |
| 950° F.+ | 3.2 | 51.8 | 100.0 |
| Feed contained 1.2 wt. % water; all results on a dry basis. Feed API gravity was 10.4; IBP was 213° F. | | | |
| Run No. 7 | | | |
| IBP–430° F. | 46.1 | 14.9 | 14.9 |
| 430–650° F. | 25.0 | 26.5 | 41.4 |
| 650–950° F. | 13.1 | 32.4 | 74.3 |
| 950° F.+ | −5.4 | 25.7 | 100.0 |
| Feed API gravity was 13.8; IBP was 179° F. | | | |
| Run No. 11 | | | |
| IBP–430° F. | 41.8 | 25.6 | 25.6 |
| 430–650° F. | 21.7 | 21.0 | 46.6 |
| 650–950° F. | 12.7 | 29.8 | 76.4 |
| 950° F.+ | −6.8 | 23.6 | 100.0 |
| Feed API gravity was 13.8; IBP was 151° F. | | | |

*Volume percents were normalized to 100% assuming all losses were in the vacuum residue. In all cases, the material balance was greater than 98%.

Mass spectral structural analyses of the feed material, the product from Run No. 7, and the product from Run No. 11 were conducted for three fractions: initial boiling point to 430° F., 430° F. to 650° F., and 650° F. to 950° F. The results of these runs are shown in Tables 10, 11, and 12.

TABLE 10

Mass Spectral Structural Analysis of Feed

| STRUCTURAL TYPE | wt. percent IBP–430° F. | 430–650° F. | 650–950° F. |
|---|---|---|---|
| Paraffins | 26.7 | 14.1 | 9.9 |
| Cycloparaffins | 28.3 | 18.1 | 9.6 |
| Condensed Cyclo-Paraffins | 25.3 | 27.9 | 18.9 |
| Alkyl Benzenes | 6.7 | 9.6 | 10.1 |
| Benzocyclo-Paraffins | 3.8 | 6.1 | 6.5 |
| Benzodicyclo-Paraffins | 2.2 | 5.2 | 5.9 |
| TOTAL | 93.0 | 81.0 | 60.9 |
| 2-Ring Aromatics | 5.4 | 12.9 | 16.3 |
| 3-Ring Aromatics | 0.8 | 3.3 | 10.0 |
| 4-Ring Aromatics | — | 1.0 | 4.9 |
| 5-Ring Aromatics | — | 0.2 | 1.0 |
| Other Aromatics | 0.3 | 1.4 | 3.8 |
| Condensed Aromatic | 0.3 | 1.4 | 3.8 |
| Sulfur Compounds | | | |
| TOTAL | 7.0 | 19.0 | 39.1 |
| Total Aromatics | 19.7 | 39.9 | 61.6 |
| Calculated API | | | |
| Measured API | | | |

TABLE 11

Mass Spectral Structural Analysis of Run No. 7

| STRUCTURAL TYPE | wt. percent IBP–430° F. | 430–650° F. | 650–950° F. |
|---|---|---|---|
| Paraffins | 38.5 | 14.9 | 10.0 |
| Cycloparaffins | 33.2 | 16.4 | 9.0 |
| Condensed Cyclo-Paraffins | 13.3 | 24.7 | 17.0 |
| Alkyl Benzenes | 10.9 | 13.1 | 10.5 |
| Benzocyclo-Paraffins | 1.8 | 7.6 | 6.9 |
| Benzodicylo-Paraffins | 0.8 | 5.5 | 5.7 |
| TOTAL | 98.5 | 82.2 | 59.1 |

TABLE 11-continued

Mass Spectral Structural Analysis of Run No. 7

| STRUCTURAL TYPE | wt. percent IBP–430° F. | 430–650° F. | 650–950° F. |
|---|---|---|---|
| 2-Ring Aromatics | 1.3 | 12.4 | 17.8 |
| 3-Ring Aromatics | 0.1 | 2.7 | 10.7 |
| 4-Ring Aromatics | 0.1 | 0.9 | 4.7 |
| 5-Ring Aromatics | — | 0.2 | 2.7 |
| Other Aromatics | — | 0.3 | 0.7 |
| Condensed Aromatic | — | 1.3 | 4.3 |
| Sulfur Compounds | | | |
| TOTAL | 1.5 | 17.8 | 40.9 |
| Total Aromatics | 15.0 | 44.0 | 64.0 |
| Calculated API | | | |
| Measured API | | | |

TABLE 12

Mass Spectral Structural Analysis of Run No. 11

| STRUCTURAL TYPE | wt. percent IBP–430° F. | 430–650° F. | 650–950° F. |
|---|---|---|---|
| Paraffins | 35.5 | 13.7 | 9.7 |
| Cycloparaffins | 30.7 | 15.0 | 8.9 |
| Condensed Cyclo-Paraffins | 16.1 | 24.1 | 17.0 |
| Alkyl Benzenes | 10.5 | 13.0 | 10.3 |
| Benzocyclo-Paraffins | 3.2 | 7.1 | 6.5 |
| Benzodicyclo-Paraffins | 1.4 | 6.2 | 5.5 |
| TOTAL | 97.4 | 79.1 | 57.9 |
| 2-Ring Aromatics | 2.3 | 14.2 | 18.1 |
| 3-Ring Aromatics | 0.3 | 3.5 | 11.2 |
| 4-Ring Aromatics | — | 1.1 | 4.7 |
| 5-Ring Aromatics | — | 0.2 | 2.9 |
| Other Aromatics | — | 0.2 | 0.7 |
| Condensed Aromatic | — | 1.7 | 4.5 |
| Sulfur Compounds | | | |
| TOTAL | 2.6 | 20.9 | 42.1 |
| Total Aromatics | 17.7 | 47.2 | 64.4 |
| Calculated API | | | |
| Measured API | | | |

EXPERIMENTAL V

A sample of Canadian Cold Lake heavy oil was processed in a direct oxidative heating pilot simulator. The reactor consisted of the following three sections: a heat exchanger, a string section, and a reactor section. The heat exchanger was located aboveground and consisted of 240 feet of ½-inch tubing inside 1-inch tubing. The string section was underground and consisted of A250 feet of ⅜-inch and 1-inch pipe leading from ground level down to the reactor section. The reactor section was 100 feet long and consisted of ⅜-inch and 3-inch pipe at the bottom of the reactor. All three sections had the smaller diameter tubing concentrically located within the larger diameter tubing. The hydrocarbon feed flow in the string and reactor sections passed down the inside pipe and returned up the outside pipe.

Sixteen temperature sensing devices were placed at various locations within the reactor. Temperature sensor Nos. 1 and 2 were located 100 feet and 200 feet, respectively, down from the ground and monitored the feed temperature. Temperature sensor No. 3 was located near the bottom of the reactor section, approximately 95 feet from the top of the reactor and measured the product temperature. Temperature sensor Nos. 4 and 5 were located between 95 feet and 78 feet from the top of the reactor and measured, respectively, the heater temperature and the outside skin temperature of the reactor wall. Temperature sensor No. 6 was located 78 feet from the top of the reactor section and measured the product temperature. Temperature sensor Nos. 8 and 9 were located between 75 feet and 50 feet from the reactor top and measured the product temperature and heater temperature, respectively. Temperature sensor No. 10 was located 50 feet down from the top of the reactor and measured the product temperature. Temperature sensor Nos. 12, 13, and 14 were located less than 50 feet from the top of the reactor section and measured, respectively, the skin temperature, the product temperature, and the heater temperature. Temperature sensor Nos. 15 and 16 measured the product temperature and were located 250 feet and 100 feet, respectively, from the surface.

Pressure sensors were also installed in the reactor. Pressure sensor No. 1 was located near the bottom of the reactor section below the oxidizing agent injection nozzle. Pressure sensor No. 2 was located on the oxidizing agent injection line prior to introduction into the reactor.

The injector system included liquid oxygen and nitrogen storage tanks, Sierra flow controllers, a Haskel air driven compressor, a custom fabricated injection nozzle, and a compressed nitrogen emergency back up system. From the liquid tanks, the gas was passed through evaporators and regulators set at 175 psi. The gas was then passed through Sierra flow controllers which controlled the flow of each gas to the compressor. The capacities of the flow controllers were at 3 scfm for the oxygen line and 6 scfm for the nitrogen line. Separate systems provided for oxygen and nitrogen service to the inlet of the air driven compressor. The two gases were combined throughout the remainder of the system. The oxygen and nitrogen were compressed to the system pressure by a Haskell air driven two-stage compressor. The compressor was rated at 5.9 scfm.

The injection nozzle was fabricated by placing a ½-inch long plug in the end of a length of ¼-inch tubing. The plug had previously been bored with a 1/32-inch diameter hole for the first ¼-inch and a 1/64-inch diameter hole for the remaining ¼-inch. The nozzle was placed vertically pointing upwards half way between the 3-inch outer pipe and the ⅜ inch inner pipe. Immediately preceding entry to the 3-inch pipe, a check valve and 5-micron filter were installed to prevent the nozzle from being plugged by foreign particles and to prevent oil from entering the gas line. The nozzle was approximately 25 feet from the bottom of the 98-foot reactor section.

An emergency nitrogen flood system was used to prevent the possibility of hydrocarbon feed from entering the injector line and producing an explosive mixture with subsequent oxygen flow. This back up system consisted of a manifold of six compressed nitrogen bottles connected to the gas injection line. The compressed nitrogen was isolated from the injection line by a solenoid valve connected to a manual switch. This switch was also connected to another solenoid valve on the drive air for the Haskell compressor. Activating this switch caused the compressor to shut down and the compressed nitrogen to flood the injection line.

The reactor section of the system was modified to include an electric heating system. The reactor section was fitted with 800-watt heaters as follows. The bottom section was fitted with 30 bands spaced 3 inches apart, and the top three sections each had 18 bands spaced 14 inches apart.

Throughout the run, the oil feed flow rate was held nearly constant at 1 gallon per minute and the feed temperature between about 80° C. and 88° C. Canadian Cold Lake Heavy Oil was used as the feed. The system pressure was initially maintained at 1200 psig. During the last half of the run, the pressure was gradually reduced to 1000 psig.

The oxygen flow rate was 0 for the first 26 hours of the run. It was then started at 0.08 scfm, and over the next 12 hours, it was gradually increased to 1.2 scfm (37.8 scf/bbl or 3.37 lb/bbl), where it was held for the remainder of the run.

After the initial heating period, the maximum temperature was held near 425° C. for about 10 hours. It was then raised to between 435° C. and 445° C. and held there for most of the next 30 hours. The maximum temperature was then lowered to between 425° C. and 435° C. for the remainder of the run. Direct oxidation of the hydrocarbon stream provided a final temperature increase of about 25° C. to 30° C.

Table 13 provides temperature profiles at 1.5 hour intervals over the run for each of temperature sensor Nos. 1–16. Table 14 shows the flow rate of oxygen and nitrogen into the reactor at one and one-half hour intervals over the run.

TABLE 13

Temperatures in Direct Oxidative Heating Pilot Simulator

| | Temperature (°C.) | | | | | | | | | | | | | | | |
|---|---|---|---|---|---|---|---|---|---|---|---|---|---|---|---|---|
| Time | 1 | 2 | 3 | 4 | 5 | 6 | 7 | 8 | 9 | 10 | 11 | 12 | 13 | 14 | 15 | 16 |
| 0:00 | 225 | 309 | 420 | 425 | 401 | 418 | 422 | 417 | 430 | 424 | 434 | 397 | 414 | 397 | 366 | 252 |
| 1:30 | 232 | 311 | 409 | 420 | 393 | 409 | 413 | 407 | 419 | 410 | 420 | 381 | 395 | 388 | 361 | 260 |
| 3:00 | 239 | 321 | 424 | 429 | 405 | 423 | 427 | 422 | 443 | 427 | 442 | 404 | 419 | 406 | 376 | 262 |
| 4:30 | 235 | 318 | 418 | 425 | 401 | 418 | 422 | 417 | 440 | 419 | 440 | 396 | 410 | 401 | 370 | 260 |
| 6:00 | 234 | 317 | 417 | 424 | 399 | 417 | 421 | 416 | 439 | 420 | 442 | 395 | 407 | 400 | 370 | 260 |
| 7:30 | 236 | 319 | 418 | 425 | 401 | 421 | 424 | 419 | 441 | 421 | 444 | 396 | 409 | 402 | 371 | 262 |
| 9:00 | 229 | 312 | 416 | 424 | 399 | 422 | 423 | 421 | 437 | 417 | 437 | 300 | 404 | 402 | 370 | 257 |
| 10:30 | 234 | 319 | 420 | 423 | 399 | 427 | 427 | 426 | 444 | 426 | 446 | 398 | 412 | 409 | 377 | 259 |
| 12:00 | 234 | 318 | 418 | 420 | 396 | 430 | 430 | 429 | 444 | 424 | 444 | 395 | 410 | 409 | 375 | 259 |
| 13:30 | 235 | 316 | 419 | 419 | 396 | 436 | 428 | 434 | 446 | 424 | 441 | 395 | 408 | 409 | 374 | 259 |
| 15:00 | 237 | 327 | 422 | 419 | 397 | 440 | 427 | 438 | 459 | 429 | 462 | 402 | 421 | 424 | 387 | 259 |
| 16:30 | 237 | 323 | 422 | 418 | 396 | 440 | 432 | 438 | 461 | 433 | 469 | 406 | 426 | 433 | 386 | 258 |
| 18:00 | 236 | 321 | 421 | 417 | 395 | 439 | 428 | 437 | 459 | 432 | 470 | 406 | 427 | 443 | 390 | 260 |
| 19:30 | 234 | 329 | 422 | 417 | 395 | 441 | 429 | 439 | 461 | 436 | 472 | 406 | 428 | 457 | 390 | 259 |
| 21:00 | 236 | 325 | 414 | 407 | 397 | 443 | 414 | 440 | 446 | 425 | 443 | 392 | 410 | 480 | 380 | 262 |
| 22:30 | 238 | 331 | 419 | 412 | 391 | 443 | 430 | 440 | 452 | 423 | 450 | 395 | 411 | 478 | 379 | 262 |
| 24:00 | 238 | 329 | 420 | 413 | 392 | 448 | 430 | 445 | 458 | 432 | 459 | 403 | 424 | 494 | 387 | 265 |
| 25:30 | 240 | 337 | 421 | 412 | 392 | 451 | 423 | 448 | 459 | 429 | 458 | 403 | 425 | 512 | 389 | 265 |
| 27:00 | 226 | 313 | 400 | 403 | 384 | 408 | 406 | 407 | 441 | 411 | 453 | 399 | 415 | 525 | 386 | 260 |

TABLE 13-continued

| Time | Temperatures in Direct Oxidative Heating Pilot Simulator Temperature (°C.) 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 28:30 | 245 | 335 | 407 | 407 | 383 | 436 | 418 | 437 | 454 | 418 | 452 | 394 | 416 | 516 | 385 | 275 |
| 30:00 | 245 | 344 | 416 | 418 | 393 | 445 | 429 | 444 | 462 | 426 | 461 | 403 | 424 | 522 | 394 | 275 |
| 31:30 | 245 | 345 | 416 | 417 | 393 | 445 | 426 | 445 | 463 | 427 | 463 | 405 | 426 | 531 | 394 | 274 |
| 33:00 | 247 | 349 | 414 | 415 | 392 | 443 | 422 | 441 | 463 | 425 | 464 | 405 | 426 | 537 | 393 | 276 |
| 34:30 | 248 | 349 | 413 | 415 | 391 | 443 | 419 | 442 | 466 | 426 | 465 | 405 | 426 | 547 | 393 | 280 |
| 36:00 | 248 | 356 | 412 | 414 | 391 | 443 | 420 | 442 | 466 | 426 | 465 | 405 | 426 | 541 | 392 | 278 |
| 37:30 | 246 | 355 | 412 | 415 | 391 | 445 | 418 | 443 | 466 | 430 | 468 | 408 | 428 | 523 | 390 | 278 |
| 39:00 | 247 | 354 | 409 | 412 | 388 | 444 | 421 | 444 | 464 | 427 | 468 | 407 | 427 | 511 | 386 | 278 |
| 40:30 | 246 | 357 | 408 | 413 | 388 | 443 | 415 | 443 | 463 | 429 | 470 | 409 | 429 | 541 | 386 | 280 |
| 42:00 | 246 | 359 | 408 | 413 | 388 | 443 | 421 | 442 | 464 | 426 | 472 | 410 | 430 | 556 | 385 | 280 |
| 43:30 | 248 | 364 | 406 | 412 | 387 | 442 | 414 | 441 | 463 | 431 | 472 | 412 | 431 | 560 | 383 | 282 |
| 45:00 | 218 | 360 | 402 | 411 | 385 | 439 | 410 | 438 | 461 | 423 | 469 | 411 | 429 | 563 | 374 | 283 |
| 46:30 | 249 | 364 | 402 | 411 | 384 | 433 | 426 | 433 | 458 | 422 | 468 | 411 | 430 | 568 | 369 | 280 |
| 48:00 | 249 | 361 | 400 | 410 | 383 | 436 | 413 | 435 | 459 | 420 | 469 | 409 | 428 | 573 | 369 | 284 |
| 49:30 | 249 | 350 | 392 | 400 | 376 | 435 | 408 | 433 | 452 | 417 | 459 | 407 | 425 | 465 | 364 | 285 |
| 51:00 | 246 | 337 | 380 | 396 | 367 | 424 | 396 | 424 | 441 | 406 | 448 | 395 | 413 | 408 | 351 | 281 |
| 52:30 | 242 | 329 | 374 | 393 | 365 | 420 | 392 | 418 | 440 | 404 | 448 | 393 | 409 | 401 | 344 | 279 |
| 54:00 | 239 | 325 | 373 | 396 | 365 | 409 | 397 | 410 | 433 | 397 | 445 | 391 | 409 | 448 | 342 | 277 |
| 55:30 | 249 | 343 | 384 | 407 | 375 | 424 | 412 | 419 | 445 | 410 | 452 | 397 | 414 | 469 | 347 | 285 |
| 57:00 | 243 | 336 | 381 | 405 | 374 | 410 | 412 | 419 | 438 | 404 | 446 | 394 | 412 | 472 | 347 | 280 |
| 58:30 | 247 | 344 | 385 | 409 | 377 | 430 | 405 | 432 | 445 | 411 | 450 | 397 | 414 | 472 | 349 | 283 |
| 60:00 | 246 | 352 | 392 | 415 | 382 | 438 | 416 | 437 | 454 | 419 | 458 | 402 | 419 | 476 | 354 | 281 |
| 61:30 | 248 | 347 | 390 | 413 | 382 | 434 | 416 | 427 | 451 | 417 | 455 | 403 | 420 | 468 | 355 | 285 |
| 63:00 | 246 | 346 | 388 | 413 | 382 | 436 | 408 | 435 | 450 | 417 | 455 | 403 | 419 | 475 | 355 | 286 |
| 64:30 | 249 | 352 | 392 | 416 | 384 | 441 | 414 | 440 | 456 | 419 | 461 | 406 | 423 | 478 | 357 | 287 |
| 66:00 | 249 | 353 | 393 | 416 | 384 | 440 | 413 | 440 | 456 | 419 | 462 | 406 | 423 | 479 | 357 | 287 |
| 67:30 | 248 | 348 | 390 | 415 | 383 | 430 | 422 | 430 | 451 | 414 | 460 | 406 | 423 | 483 | 357 | 289 |
| 69:00 | 251 | 361 | 397 | 420 | 388 | 443 | 417 | 443 | 465 | 430 | 473 | 413 | 429 | 512 | 362 | 288 |
| 70:30 | 249 | 354 | 389 | 407 | 378 | 425 | 414 | 425 | 452 | 415 | 466 | 411 | 426 | 523 | 359 | 288 |
| 72:00 | 250 | 358 | 390 | 411 | 379 | 436 | 415 | 436 | 459 | 420 | 469 | 410 | 425 | 526 | 358 | 290 |
| 73:30 | 247 | 357 | 396 | 406 | 381 | 431 | 414 | 437 | 457 | 430 | 471 | 416 | 430 | 530 | 365 | 281 |
| 75:00 | 248 | 352 | 393 | 408 | 380 | 424 | 415 | 423 | 452 | 419 | 466 | 410 | 426 | 536 | 359 | 282 |
| 76:30 | 249 | 351 | 393 | 409 | 381 | 425 | 415 | 426 | 452 | 416 | 465 | 410 | 425 | 546 | 359 | 280 |
| 78:00 | 249 | 350 | 394 | 408 | 381 | 426 | 414 | 427 | 452 | 415 | 465 | 410 | 425 | 548 | 359 | 280 |
| 79:30 | 248 | 353 | 395 | 409 | 382 | 429 | 419 | 429 | 454 | 415 | 465 | 410 | 425 | 548 | 359 | 281 |
| 81:00 | 208 | 305 | 381 | 179 | 167 | 409 | 376 | 426 | 424 | 408 | 426 | 409 | 404 | 486 | 311 | 214 |
| 82:30 | 153 | 227 | 350 | 83 | 81 | 355 | 301 | 382 | 382 | 373 | 383 | 376 | 380 | 429 | 234 | 160 |
| 84:00 | 112 | 171 | 327 | 63 | 62 | 307 | 208 | 345 | 348 | 340 | 347 | 343 | 346 | 395 | 187 | 120 |

TABLE 14

| Time | Flowrates of Oxygen and Nitrogen in Direct Oxidative Heating Pilot Simulator Flowrate (scfm) $N_2$ | $O_2$ |
|---|---|---|
| 0:00 | 1.37 | 0.01 |
| 1:30 | 1.37 | 0.01 |
| 3:00 | 1.38 | 0.00 |
| 4:30 | 1.69 | 0.01 |
| 6:00 | 1.65 | 0.01 |
| 7:30 | 1.60 | 0.09 |
| 9:00 | 1.45 | 0.19 |
| 10:30 | — | — |
| 12:00 | 1.21 | 0.50 |
| 13:30 | 1.14 | 0.69 |
| 15:00 | 0.97 | 0.79 |
| 16:30 | 0.97 | 0.79 |
| 18:00 | 0.96 | 0.79 |
| 19:30 | 0.82 | 0.89 |
| 21:00 | 0.45 | 1.18 |
| 23:15 | 0.49 | 1.19 |
| 24:00 | 0.42 | 1.19 |
| 25:30 | 0.46 | 1.18 |
| 27:00 | 1.07 | 0.49 |
| 28:30 | 0.45 | 1.19 |
| 30:00 | 0.42 | 1.18 |
| 31:30 | 0.33 | 1.21 |
| 33:00 | 0.33 | 1.19 |
| 34:30 | 0.33 | 1.18 |
| 36:00 | 0.36 | 1.18 |
| 37:30 | 0.32 | 1.18 |
| 39:00 | 0.34 | 1.18 |
| 40:30 | 0.34 | 1.19 |
| 42:00 | 0.35 | 1.18 |
| 43:30 | 0.35 | 1.19 |

TABLE 14-continued

| Time | Flowrates of Oxygen and Nitrogen in Direct Oxidative Heating Pilot Simulator Flowrate (scfm) $N_2$ | $O_2$ |
|---|---|---|
| 45:00 | 0.37 | 1.17 |
| 46:30 | 0.35 | 1.18 |
| 48:00 | 0.35 | 1.18 |
| 49:30 | 0.30 | 1.19 |
| 51:00 | 0.30 | 1.19 |
| 52:30 | 0.23 | 1.19 |
| 54:00 | 0.19 | 1.18 |
| 55:30 | 0.25 | 1.10 |
| 57:00 | 0.23 | 1.12 |
| 58:30 | 0.30 | 1.19 |
| 60:00 | 0.32 | 1.19 |
| 61:30 | 0.28 | 1.19 |
| 63:00 | 0.31 | 1.19 |
| 64:30 | 0.31 | 1.19 |
| 66:00 | 0.33 | 1.19 |
| 67:30 | 0.29 | 1.18 |
| 69:00 | 0.31 | 1.19 |
| 70:30 | 0.31 | 1.19 |
| 72:00 | 0.31 | 1.19 |
| 73:30 | 0.23 | 1.19 |
| 75:00 | 0.17 | 1.20 |
| 76:30 | 0.13 | 1.20 |
| 78:00 | 0.12 | 1.19 |
| 79:30 | 0.12 | 1.19 |
| 81:00 | 1.38 | −0.02 |
| 82:30 | 0.36 | −0.01 |
| 84:00 | 1.69 | −0.02 |

Table 15 contains data from pressure sensor Nos. 1 and 2 at two hour intervals over most of the run.

TABLE 15

| Pressures in Direct Oxidative Heating Pilot Simulator | |
|---|---|
| Time | Reaction Pressure (psig) |
| 0:00 | 1330 |
| 2:00 | 1328 |
| 4:00 | 1329 |
| 6:00 | 1333 |
| 8:00 | 1322 |
| 10:00 | 1330 |
| 12:00 | 1324 |
| 14:00 | 1304 |
| 16:00 | 1298 |
| 18:00 | 1305 |
| 20:00 | 1297 |
| 22:00 | 1308 |
| 24:00 | 1308 |
| 26:00 | 1309 |
| 28:00 | 1326 |
| 30:00 | 1311 |
| 32:00 | 1303 |
| 34:00 | 1314 |
| 36:00 | 1325 |

TABLE 15-continued

| Pressures in Direct Oxidative Heating Pilot Simulator | |
|---|---|
| Time | Reaction Pressure (psig) |
| 38:00 | 1350 |
| 40:00 | 1370 |
| 42:00 | 1415 |
| 44:00 | 1436 |
| 46:00 | 1491 |
| 48:00 | 1498 |
| 50:00 | 1485 |
| 52:00 | 1587 |

Eight sample barrels were taken from the product stream at [approximately 25 hours, 30 hours, 40 hours, 45 hours, 57 hours, 69 hours, 81 hours, and 92 hours]. The analytical results of the test run for Barrels 1–8 are provided below in Table 16.

TABLE 16

Analytical Results

| Run | Temp °C.** | Pressure, psi | $O_2$ Inlet Wt % | Feed $H_2O$ % | Time min | Product $H_2O$ % | Viscosity cp 25° C. | Viscosity cp 80° C. | Gravity °API | Residual Wt % | Residual Conv % |
|---|---|---|---|---|---|---|---|---|---|---|---|
| Cold Lake Crude | | | | | | | | | | | |
| Feed | | | | | | | 44,229 | 213 | 10.3 | 62.1 | |
| Bbl #1 | 419 | 1330 | 0.00 | 9.6 | 13.4 | 5.6 | 938 | 50 | 12.6 | 49.6 | 20.1 |
| Bbl #2 | 421 | 1325 | 0.10 | 11.2 | 14.1 | 8.0 | 839 | 47 | 12.6 | 49.0 | 21.1 |
| Bbl #3 | 435 | 1309 | 0.95 | 13.4 | 12.1 | 12.8 | 444 | 22 | 12.3 | 37.4 | 39.8 |
| Bbl #4 | 439 | 1302 | 1.40 | 11.8 | 13.4 | 11.5 | 222 | 24 | 15.9 | 40.3 | 35.1 |
| Bbl #5 | 434 | 1316 | 1.25 | 4.7 | 10.9 | 4.7 | 335 | 25 | 12.9 | 39.3 | 36.7 |
| Bbl #6 | 430 | 1498 | 1.30 | 3.5 | 9.2 | 3.4 | 322 | 24 | 13.2 | 40.4 | 34.9 |
| Bbl #7 | 420 | 1467 | 1.12 | 3.2 | 6.8 | 3.0 | 562 | 36 | 12.4 | 41.2 | 33.7 |
| Bbl #8 | 420 | 1694 | 1.22 | 3.2 | 5.9 | 2.4 | 560 | 34 | 12.3 | 41.5 | 33.2 |

| Run | Asphaltene* Wt % | Asphaltene* Alter % | Solid Wt % | Coke Wt % | Concarbon Wt % | Sulfur Wt % | Pour Point °C. | Gas Wt % | IBP–450° F. Wt % | 450–950° F. Wt % | Residual +950° F. Wt % |
|---|---|---|---|---|---|---|---|---|---|---|---|
| Feed | 15.7 | | 0.17 | | 13.5 | 4.2 | 4 | 0.6 | 2.3 | 35.1 | 62.1 |
| Bbl #1 | 14.5 | 7.6 | 0.22 | 0.26 | 13.0 | 3.7 | −15 | 3.9 | 3.9 | 42.6 | 49.6 |
| Bbl #2 | 14.1 | 10.2 | 0.25 | 0.29 | 14.2 | 3.7 | −25 | 3.0 | 6.7 | 41.4 | 49.0 |
| Bbl #3 | 13.9 | 11.5 | 0.56 | 0.59 | 15.3 | 4.0 | −27 | 5.5 | 10.8 | 46.4 | 37.6 |
| Bbl #4 | 13.2 | 15.9 | 0.42 | 0.46 | 14.4 | 3.5 | −36 | 4.9 | 15.1 | 39.7 | 40.3 |
| Bbl #5 | 14.2 | 9.6 | 0.36 | 0.43 | 15.2 | 3.8 | −33 | 3.2 | 12.1 | 45.4 | 39.3 |
| Bbl #6 | 13.8 | 12.1 | 0.30 | 0.56 | 14.9 | 3.9 | −36 | 5.4 | 8.1 | 46.1 | 40.4 |
| Bbl #7 | 14.4 | 8.3 | 0.21 | 0.31 | 13.9 | 4.0 | −35 | 3.2 | 11.5 | 44.3 | 41.2 |
| Bbl #8 | 14.3 | 8.9 | 0.27 | 0.45 | 14.0 | 4.0 | −33 | 3.1 | 11.2 | 44.3 | 41.5 |

| Run | Vol % | IBP–450° F. °API | IBP–450° F. Sp gr | Volume % 450–650° F. | Volume % 650–950° F. | 450–950° F. °API | 450–950° F. Sp gr | Sulfur Distribution % Liquid | Sulfur Distribution % Gas | Sulfur Distribution % Solids |
|---|---|---|---|---|---|---|---|---|---|---|
| Feed | 2.7 | 38.8 | 0.831 | 17.0 | 20.8 | 21.1 | 0.927 | | | |
| Bbl #1 | 4.5 | 35.9 | 0.845 | 27.5 | 18.0 | 20.8 | 0.929 | 86 | 11 | 0 |
| Bbl #2 | 8.1 | 39.1 | 0.829 | 22.2 | 22.6 | 21.0 | 0.928 | 83 | 14 | 0 |
| Bbl #3 | 12.9 | 37.5 | 0.837 | 28.4 | 20.9 | 19.4 | 0.938 | 91 | 12 | 0 |
| Bbl #4 | 18.5 | 44.5 | 0.804 | 21.6 | 20.2 | 20.2 | 0.933 | 81 | 16 | 0 |
| Bbl #5 | 14.6 | 40.6 | 0.822 | 24.0 | 24.1 | 19.5 | 0.937 | 88 | 12 | 0 |
| Bbl #6 | 9.7 | 38.6 | 0.832 | 23.9 | 25.4 | 19.8 | 0.935 | 88 | 13 | 0 |
| Bbl #7 | 13.5 | 36.0 | 0.845 | 24.2 | 22.4 | 18.4 | 0.944 | 91 | 12 | 0 |
| Bbl #8 | 13.8 | 42.6 | 0.813 | 24.7 | 22.7 | 20.2 | 0.933 | 95 | 13 | 0 |

| Run | $H_2$ | $CH_4$ | CO | $CO_2$ | $C_2H_6$ | $H_2S$ | $C_3H_8$ | $C_2H_4$ | $C_3H_6$ | n-$C_4H_{10}$ | i-$C_4H_{10}$ | Other | $N_2$ |
|---|---|---|---|---|---|---|---|---|---|---|---|---|---|
| Feed | | | | | | | | | | | | | |
| Bbl #1 | 1.0 | 13.9 | 1.2 | 2.1 | 5.5 | 14.0 | 6.9 | 0.6 | 2.1 | 4.3 | 1.4 | 4.4 | 42.9 |
| Bbl #2 | 3.7 | 14.9 | 6.8 | 5.8 | 5.8 | 13.3 | 6.7 | 0.4 | 1.8 | 6.7 | 2.1 | 2.9 | 29.1 |
| Bbl #3 | 5.4 | 20.0 | 5.2 | 6.6 | 7.5 | 13.9 | 8.5 | 0.4 | 1.8 | 5.0 | 1.6 | 3.8 | 20.4 |
| Bbl #4 | 6.4 | 20.2 | 6.8 | 11.7 | 7.6 | 15.5 | 9.0 | 0.4 | 1.9 | 5.6 | 1.7 | 1.0 | 8.6 |
| Bbl #5 | 5.2 | 23.5 | 5.1 | 11.9 | 8.6 | 15.4 | 9.9 | 0.4 | 1.9 | 5.8 | 1.9 | 4.4 | 6.1 |
| Bbl #6 | 6.8 | 22.7 | 3.8 | 13.5 | 8.4 | 15.6 | 9.8 | 0.3 | 1.7 | 6.1 | 2.0 | 5.2 | 4.0 |
| Bbl #7 | 4.7 | 20.6 | 1.7 | 15.8 | 7.6 | 18.9 | 9.0 | 0.3 | 1.7 | 5.5 | 1.8 | 4.5 | 7.9 |
| Bbl #8 | 15.9 | 15.5 | 8.9 | 18.0 | 6.1 | 13.4 | 6.6 | 0.4 | 1.5 | 4.2 | 1.2 | 3.4 | 4.8 |

*Water- and solids-free basis.

**Temperature is the average of two temperature indicators located between 50 and 75 down from the top of the reactor.

While various embodiments of the present invention have been described in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. A process for reducing the viscosity of hydrocarbons, said process comprising:
   (a) introducing a hydrocarbon feed stream into a vessel, said stream comprising a core portion and a boundary layer;
   (b) increasing the bulk temperature of said stream from a first bulk temperature to a second bulk temperature;
   (c) introducing an amount of an oxidizing agent into said core portion of said stream to oxidize components in said stream and provide heat to said core portion of said stream to produce a bulk reaction temperature greater than said second bulk temperature;
   (d) controlling the amount of said oxidizing agent to maintain said reaction bulk temperature below the coking temperature of said feed; and
   (e) maintaining said reaction bulk temperature to produce a reaction product having a lower viscosity than said feed.

2. A process as claimed in claim 1, wherein said second bulk temperature is at least about 300° C.

3. The method of claim 1 wherein said reaction temperature is between about 300° C. and about 475° C.

4. A process as claimed in claim 1, wherein said oxidizing agent comprises oxygen.

5. A process as claimed in claim 1, wherein said hydrocarbon feed is under a pressure above about 1000 psi at said reaction temperature.

6. A process as claimed in claim 1, wherein the step of increasing the temperature of said stream from the first bulk temperature to the second bulk temperature comprises providing thermal communication between said reaction product and said feed stream.

7. A process as claimed in claim 1, wherein the differential between said second bulk temperature and said reaction bulk temperature is less than about 35° C.

8. A process as claimed in claim 7, wherein said differential is less than about 25° C.

9. A process as claimed in claim 1, wherein the step of introducing an oxidizing agent, comprises injecting said oxidizing agent into said stream through an injection nozzle at an injection pressure greater than the pressure of the feed at the point of injection.

10. A process as claimed in claim 9, wherein said injection pressure is at least about 50 psi greater than the pressure of the feed.

11. A process as claimed in claim 9, wherein said oxidizing agent is injected into said stream substantially parallel to the line of flow of said stream.

12. A process as claimed in claim 9, wherein said oxidizing agent is introduced at more than one site in said vessel.

13. A process as claimed in claim 5, wherein less than about 10 volume percent of said feed stream is in a vapor phase in said reaction zone.

14. A process as claimed in claim 1, wherein the viscosity of said reaction product is at least about 90 percent lower than the viscosity of said feed.

15. A process as claimed in claim 1, wherein the API gravity of said reaction product is increased by at least about 2° at 25° C. compared to said feed.

16. A process as claimed in claim 1, wherein the pour point of said reaction product is reduced by at least about 20° C. compared to said feed.

17. A method for reducing the viscosity of a hydrocarbon feed by thermal degradation of heavy molecular weight components of the feed at a reaction temperature, said method comprising heating the feed with a heat source to below a reaction temperature and heating the feed to the reaction temperature by internal combustion of a portion of the feed.

18. In a method for reducing the viscosity of a hydrocarbons using a vertical tube reactor in which an influent stream of hydrocarbon feed is increased from a first temperature to a second temperature by heat exchange between said influent stream and an effluent product stream wherein at least one of said streams is in turbulent flow and the pressure on said hydrocarbon feed is increased from a first pressure to a second pressure by the hydrostatic column of said feed the improvement comprising providing an incremental amount of heat to increase the bulk temperature of said feed from said second temperature to a reaction temperature by introducing an oxidizing agent into a core portion of said feed stream to oxidize components in said feed stream.

19. The method of claim 18 wherein said reaction temperature is between about 300° C. and about 475° C.

20. The method of claim 18 wherein said second bulk temperature is between about 300° C. and about 475° C. and said reaction temperature is within about 35° C. of said second temperature.

21. The method of claim 18 wherein said second pressure is at least about 1000 psi.

22. The method of claim 18 wherein said oxidizing agent is oxygen.

23. The method of claim 18 wherein said hydrocarbon feed is selected from the group consisting of whole crude oil, bitumen, kerogen, shale oils, tar sands oil and mixtures thereof.

24. The method of claim 18 wherein said turbulent flow is vertical multiphase flow.

25. The method of claim 18 wherein volatile components are separated from said effluent product stream and introduced into said influent stream to provide multiphase flow in said influent stream.

26. A method for reducing the viscosity of a whole crude oil said method comprising:
   (a) passing said oil as an influent stream into the downcomer of a vertical tube reactor to form a column of fluid;
   (b) bringing said influent stream into heat exchange contact with an effluent product stream both of said streams being in vertical multiphase flow to increase the temperature of said influent stream to a heat exchange temperature of between about 300° C. and about 475° C.;
   (c) increasing the pressure on said influent stream from an inlet pressure to a reaction pressure of at least about 1000 psi by said column fluid;
   (d) injecting oxygen into a core portion of said influent stream to increase the bulk temperature of said stream to a reaction temperature which is within about 35° C. of said heat exchange temperature;
   (e) maintaining said oil at said reaction temperature to provide a preselected reduction in viscosity of said oil and provide a product; and
   (f) passing said product up a riser as an effluent stream into heat exchange contact with said influent stream.

27. The method of claim 1 wherein said hydrocarbons are selected from the group consisting of whole crude oil, tar sands oil, bitumen, kerogen, shale oil, and mixtures thereof.

28. The method of claim 1 wherein the amount of said oxidizing agent is controlled by:

(a) monitoring the bulk temperature of the hydrocarbon stream downstream from an oxidation reaction zone; and (b) adjusting flow of oxidizing agent to maintain said bulk temperature within a preselected temperature range by:

(i) increasing the flow of oxidizing agent when the bulk temperature approaches the lower limit of the preselected temperature range; and (ii) decreasing the flow of oxidizing agent when the bulk temperature approaches the upper limit of the preselected temperature range.

29. The method of claim 18 wherein the pressure at said reaction temperature is sufficient to maintain the hydrocarbon stream substantially in liquid phase.

30. The method of claim 29 wherein at least about 90 volume percent of said hydrocarbon stream is in liquid phase.

31. The method of claim 27 wherein said hydrocarbon feed stream contains less than about 13 weight percent water.

* * * * *

UNITED STATES PATENT AND TRADEMARK OFFICE
CERTIFICATE OF CORRECTION

PATENT NO. : 4,818,371

DATED : April 4, 1989

INVENTOR(S) : Bain et al.

It is certified that error appears in the above-identified patent and that said Letters Patent is hereby corrected as shown below:

On the title page:

In the References Cited, U.S. PATENT DOCUMENTS section correct the noted references as follows:

Beddoes, delete "887,506" and insert -- 895,229 --; and delete "5/1908" and insert -- 8/1908 --;

Patent No. 2,160,814, delete "196/150" and insert -- 196/50 --;

Patent No. 2,421,528, delete "6/1952" and insert -- 6/1947 --;

Patent No. 2,587,703, delete "Deansely" and insert --Deanesly --;

Patent No. 2,818,419, delete "McKenley et al." and insert -- McKinley et al. --; delete "208/3" and insert -- 260,451 --;

Patent No. 2,844,452, delete "Husche" and insert -- Hasche --; delete "208/7" and insert -- 48/196 --;

Patent No. 2,862,870, delete "Voorhies" and insert -- Voorhies, Jr. --;

Patent No. 3,156,642, delete "Tranlham et al." and insert -- Trantham et al. --; delete "208/3" and insert -- 208/120 --;

Patent No. 3,170,863, delete "Spillave et al." and insert -- Spillane et al. --;

Patent No. 3,310,109, delete "Marx" and insert -- Marx et al. --;

UNITED STATES PATENT AND TRADEMARK OFFICE

CERTIFICATE OF CORRECTION

PATENT NO. : 4,818,371

DATED : April 4, 1989

INVENTOR(S) : Bain et al.

It is certified that error appears in the above-identified patent and that said Letters Patent is hereby corrected as shown below:

Patent No. 3,320,154, delete "Tokuhisha et al." and insert -- Tokuhisa et al. --; delete "208/106" and insert -- 208/130 --;

Patent No. 3,474,596, delete "208/106" and insert -- 55/45 --;

Patent No. 4,252,634, delete "Knulbe et al." and insert -- Khulbe et al. --;

Patent No. 4,334,976, delete "208/81 E" and insert -- 208/8 LE --;

Patent No. 4,448,665, delete "208/82 E" and insert -- 208/8 LE --;

Patent No. 4,560,467, delete "Slapp" and insert -- Stapp --; delete "208/106" and insert -- 208/89 --;

Patent No. 4,631,384, delete "208/3" and insert -- 219/121 --;

In the References Cited, FOREIGN PATENT DOCUMENTS section, correct the noted references as follows:

Patent No. 420,650, delete "3/1974" and insert -- 8/1974 --; delete "208/106" and insert -- 208/116 --;

UNITED STATES PATENT AND TRADEMARK OFFICE

CERTIFICATE OF CORRECTION

PATENT NO. : 4,818,371

DATED : April 4, 1989

INVENTOR(S) : Bain et al.

It is certified that error appears in the above-identified patent and that said Letters Patent is hereby corrected as shown below:

In the References Cited, OTHER PUBLICATIONS section, correct the noted references as follows:

Visbreaking: A Flexible Process, delete "Rnoe" and insert -- Rhoe --;

Visbreaking: More Feed for FCC, delete "Kunn" and insert -- Kuhn --; delete "Nocarbartolo" and insert -- Notarbartolo --;

Thermal Visbreaking of Heavy Residues, delete "Goldtnwalt" and insert -- Goldthwait --;

UNITED STATES PATENT AND TRADEMARK OFFICE

CERTIFICATE OF CORRECTION

PATENT NO. : 4,818,371

DATED : April 4, 1989

INVENTOR(S) : Bain et al.

It is certified that error appears in the above-identified patent and that said Letters Patent is hereby corrected as shown below:

Column 1, line 31, delete "stream" and insert therefor --steam--.

Column 1, line 63, delete "equalizing" and insert therefor --equaling--.

Column 2, line 40, begin a new paragraph after "froth".

Column 3, line 22, delete "thermaly" and insert therefor --thermal--.

Column 4, line 53, delete "increase" and insert therefor --increases--.

Column 5, line 47, delete "unexpectly" and insert therefor --unexpectedly--.

Column 5, line 54, delete "hyrocarbon" and insert therefor --hydrocarbon--.

UNITED STATES PATENT AND TRADEMARK OFFICE

CERTIFICATE OF CORRECTION

PATENT NO. : 4,818,371

DATED : April 4, 1989

INVENTOR(S) : Bain et al.

It is certified that error appears in the above-identified patent and that said Letters Patent is hereby corrected as shown below:

Column 6, line 20, after "section," insert --a--.

Column 7, line 33, insert a comma after "feed".

Column 8, line 5, delete "In" and insert therefor --If--.

Column 8, line 7, delete "system" and insert therefor --stream--.

Column 8, line 17, delete "stram" and insert therefor --stream--.

Column 9, line 56, delete "even" and insert therefor --event--.

Column 10, line 9, delete the first occurrence of "or".

Column 11, line 38, delete "downstram" and insert therefor --downstream--.

Column 11, line 64, delete "tha" and insert therefor --than--.

Column 12, line 1, delete "inffluent" and insert therefor --influent--.

Column 12, line 4, delete "andout" and insert therefor --and out--.

UNITED STATES PATENT AND TRADEMARK OFFICE

CERTIFICATE OF CORRECTION

PATENT NO. : 4,818,371

DATED : April 4, 1989

INVENTOR(S) : Bain et al.

It is certified that error appears in the above-identified patent and that said Letters Patent is hereby corrected as shown below:

Column 12, line 58, insert --an-- between "in" and "oil".

Column 12, line 59, insert --fed-- between "was" and "through".

Column 12, line 65, delete "send" and insert therefor --sand--.

Columns 17 & 18, Table 2, Run No. Feed, Coke Wt.%, delete "12.6" and insert therefor --12.0--.

Columns 17 & 18, Table 2, Run No. 2-2, Con-Carbon Wt.%, delete "12.6" and insert therefor --12.0--.

Columns 17 & 18, Table 2, Run No. 13-3, Con-Carbon Wt.%, delete "3.8" and insert therefor --12.7--.

Columns 17 & 18, Table 2, Run No. 13-3, Sulfur Wt.%, delete "-17" and insert therefor --3.8--.

Columns 17 & 18, Table 2, Run No. 13-3, Pour Pt. $^{o}$C., insert -- -17-- in the blank space.

Column 21, line 56, delete "indirecting" and insert therefor --indirect--.

UNITED STATES PATENT AND TRADEMARK OFFICE

CERTIFICATE OF CORRECTION

PATENT NO. : 4,818,371

DATED : April 4, 1989

INVENTOR(S) : Bain et al.

It is certified that error appears in the above-identified patent and that said Letters Patent is hereby corrected as shown below:

Column 26, line 48, delete "A250" and insert therefor --250--.

Column 31, lines 65-69, the two columns should be inserted into Table 15 after the time/reaction pressure entry 26:00/1309.

Column 34, line 8, delete the second occurrence of "a".

Signed and Sealed this

Third Day of March, 1992

*Attest:*

HARRY F. MANBECK, JR.

*Attesting Officer*

*Commissioner of Patents and Trademarks*